United States Patent [19]

Foster et al.

[11] Patent Number: 4,798,267

[45] Date of Patent: Jan. 17, 1989

[54] ELEVATOR SYSTEM HAVING AN IMPROVED SELECTOR

[75] Inventors: Michael M. Foster; Kermit L. Racely, both of Memphis, Tenn.

[73] Assignee: Delaware Capital Formation, Inc., Wilmington, Del.

[21] Appl. No.: 5,554

[22] Filed: Jan. 20, 1987

[51] Int. Cl.[4] ..... B66B 1/34

[52] U.S. Cl. ..... 187/28; 187/134

[58] Field of Search ..... 187/28, 32, 34, 35, 187/134, 130, 113; 116/64, 226; 335/206–207

[56] References Cited

U.S. PATENT DOCUMENTS

| | | | |
|---|---|---|---|
| 3,963,098 | 6/1976 | Lewis et al. | 187/134 |
| 4,218,671 | 8/1980 | Lewis | 187/134 |
| 4,433,756 | 2/1984 | Caputo et al. | 187/134 |
| 4,674,603 | 6/1987 | Estrella | 187/32 X |
| 4,683,990 | 8/1987 | Wright | 187/134 |

*Primary Examiner*—Joseph J. Rolla

*Assistant Examiner*—Nils E. Pedersen

*Attorney, Agent, or Firm*—Brumbaugh, Graves, Donohue & Raymond

[57] ABSTRACT

A selector for an elevator system includes a tape vertically suspended in the hoistway that includes vertically aligned holes, a first set of strip magnets for identifying landings and a second set of strip magnets for indicating a door zone level position. A selector unit mounted on the car has guides for engaging the ends of the tape, a bar magnet and a magnetic sensor disposed on opposite sides of the holes to detect car movement, a magnetic sensor array in vertical alignment with the floor landing magnets and another magnetic sensor array in vertical alignment with the door zone magnets. Preferably, the magnetic sensors are hall effect devices and are mounted on a flat board, e.g. a printed circuit board, with a special mount piece. Similarly, the bar magnets are mounted on the printed circuit board by way of a special centering mounting piece.

19 Claims, 15 Drawing Sheets

POWER CONTROLLER

ELEVATOR SYSTEM HAVING AN IMPROVED SELECTOR

FIELD OF THE INVENTION

The present invention relates to improvements in elevator systems, and particularly to the selector system thereof. The invention will be described as part of a novel hydraulic elevator control system, but it shall be understood that the selector may be employed in other elevator systems.

BACKGROUND OF THE INVENTION

Hydraulic elevators include a hydraulic jack which is mounted in the hoistway pit and supports the elevator car. A pump unit supplies hydraulic fluid from a reservoir to the jack through a solenoid-operated valve that includes flow regulating pistons for selectively raising and lowering the car. The valve is, in turn, operated by a control system. The control system performs the functions of receiving hall calls and car calls, dispatching the car to the appropriate floors, stopping the car level with the floor landings, and opening and closing the doors. Part of the overall control system is a selector, which senses the position of the elevator car in the hoistway and determines slowdown and stopping points.

Traditionally, all of the control functions of a hydraulic elevator, including those of the selector, have been performed by relay circuitry centrally located in the machine room adjacent to the pump unit. Car position signals are provided by switches mounted at appropriate locations in the hatchway. The switches are actuated by cams mounted on the car and the signals are brought to the controller by a hoistway riser.

Microprocessors possess a number of potential advantages over relay-based controls from the standpoint of system feexibility. It would be desirable, therefore to replace the selector relay controls in a hydraulic elevator with a microprocessor controller, provided that such a control could be employed with hydraulic elevator hardware in a safe and cost effective manner.

As noted before, traditionally the controller and power unit are located in the machine room. The operating temperatures and vibrations of hydraulic elevator machinery make the machine room a reltively inhospitable environment for delicate components such as microprocessors. It is not practical, then, to substitute a microprocessor control for relay circuitry without either taking special protective measures or utilizing components having higher specifications than that of typical industrial or consumer-grade components. This is undesirable from the standpoint of the higher costs involved.

Alternatively, as one manufacture has done, the microprocessor control may be relocated to another location such as on the car. However, the control circuitry in conventional hydraulic elevators is located in the machine room for accessibility and in order to be located close to the power unit, thereby minimizing the amount of power wiring. Relocating the control would require then additional wiring so that the microprocessor will still be able to communicate with the machinery and power supplies in the machine room and switches in the hoistway. To reduce installation cost and to improve reliability it is desirable to keep the amount of wiring to a minimum.

Each microprocessor has inherent limitations in terms of its input/output capabilities (number of I/O ports), processing capability, and speed. In any control system for an elevator, it is undesirable to have delays in processing and transmitting critical information, such as slowdown and stop signals, certain door control signals, and safety information. At the same time, it would be desirable from the standpoint of cost to minimize the number of dedicated terminals used by the central control for input/output with peripheral devices, to perform control functions using minimum microprocessor capability, and to perform critical decision-making functions with a minimum of delay.

As noted above, conventional hydraulic elevator selectors utilize switches mounted in the hoistway. This involves considerable installation costs, but the use of discrete switches for each control signal provides a simple method of outputting car position as a signal suitable for actuating the relay controller. Since each hoistway position requires a discrete switch, it is not practical to mount a corresponding number of separately actuated, discrete switches on the elevator car.

There is, however, an advantage to locating all the active devices in a factory-wired unit mounted on the car, and in using only inert devices in the hoistway.

One known selector system that meets these requirements consists of a tape mounted vertically in the hatch. The tape includes a series of vertically spaced holes, with sensors on the car to detect the holes, and thus count the distance of car travel. The system also includes magnets, mounted on the tape, to indicate floor level, door zone, and to identify each floor by a unique digital code. These magnets are read by separate sensors.

In practice, this system is extremely sensitive to the relative positions of the holes, magnets and sensors, and each must be precisely positioned during elevator setup. In this known system, positioning of the floor magnets and sensors is done on site, on a trial and error basis. This requires a great deal of time in elevator set up and therefore is costly. It also requires the use of personnel having specialized training in the selector system installation procedures.

It would be desirable, in conjunction especially with a microprocessor-based control system, to provide a selector system in which the active components may be mounted on the car, that will provide signals in a form readily adapted for use as microprocessor inputs, but which at the same time may be manufactured on a cost-efficient basis and installed in the field with minimum effort. It would also be desirable to utilize the same selector system to obtain signals representative of the direction of travel. It would further be desirable to minimize the installation time for a tape system employing magnetic sensors, to reduce the cost of elevator installation in the field.

SUMMARY OF THE INVENTION

The present invention is a microprocessor-based selector system in which all of the active components are mounted on the car, and which is easy to install, reliable, and relatively inexpensive to manufacture.

The selector is particularly suitable for an elevator system employing a distributed intelligence control system. By way of example, a hydraulic elevator includes a control system separated into four operating subsystems: a car logic controller ("CLC"), the selector, a door operator, and a power controller. The CLC, the door operator, and the selector are all mounted on the elevator car, and each is microprocessor-based. The power controller utilizes relays for certain control functions that are not incorporated in the CLC or other microprocessor based subsystems. The CLC is linked to the door operator and selector over a serial communications link and utilizes a polled network protocol. The power controller is controlled by signals from the CLC and, in certain instances, from the selector.

In this illustrative system, each of the subsystems, including the selector, carries out certain functions at the instruction of, but separate from the CLC. Accordingly, each of the subsystems carries out its intended functions independent of the limitations of the processing power and speed of the CLC microprocessor and independent of the speed of data transmission by way of the serial communications link. Communications between the four operating subsystems may be accomplished using a minimum of wiring and using microprocessor components matched to the processing capabilities of the particular subsystem. Each subsystem microprocessor is assigned a unique address, which makes it possible for any subsystem to communicate with any other subsystem.

Preferably, the communications link includes external access connectors for a portable terminal, to input data into the selector and read data from the selector.

A selector system according to the invention includes a steel tape having a series of laterally elongated slots spaced along the length of the tape. Strip magnets are mounted on either side of the slots to give indications of elevator floor position and the door zone locations. Preferably, each landing is identified by a series of strip magnets to provide a binary code identifying that landing.

A selector housing, which is preferably formed out of sheet metal or molded plastic with electromagnetic shielding, supports a sensor mounting board, which is preferably a piece of printed circuit board. A pair of bar magnets are mounted in holders attached to the boards, the magnets being vertically spaced and aligned relative to the center of the holes. An array of hall effect sensors is mounted on the board in position to read the strip magnets mounted on the tape. Also, plastic guides are mounted laterally to the sides of the magnets and hall effect devices. Each guide pair forms a groove for receiving opposite edges of the steel tape for guiding the tape relative to the sensors. Finally, an auxiliary sensor board is mounted opposite to the board-mounted bar magnets, so that the bar magnet and auxiliary board lie on opposite sides of the tape. A pair of hall effect sensors are mounted on the auxiliary sensor board so as to be opposite the board-mounted bar magnets.

In the exemplary system, the control functions are distributed among the subsystems. The CLC receives and latches hall calls and car calls, and sends enabling relay signals to the power controller to initiate elevator runs and control slowdown. The CLC receives signals from the selector indicative of car position and slowdown points. The CLC also instructs the door operator as to when to begin a door open cycle, and also controls door open times.

The door operator includes a pair of microprocessors and performs all the control functions for the doors except for the decisions about when to open and close. The door operator controls opening speed and stopping of the door. It includes a standard operating mode, in which it will reopen the door upon actuation of the door edge guard or light sensing device. It also includes other modes of operation, in which the door will not completely reopen or will ignore electric eye signals and attempt to close the doors with a specified amount of force, i.e., "a nudging" operation. These operating modes are programmed in the door operator microprocessor, and the mode selected for operation is determined by the CLC.

The selector reads signals from the tape indicating car position relative to floor position, and also signals indicative of levelling. Levelling signals are transmitted directly to the power controller. The CLC controls the car run until final levelling, wherein the CLC relinquishes control to the selector.

Signals representative of top and bottom terminal limits (upper and lower limits of travel in the hoistway) are provided by a switch assembly mounted on the car. The switch assembly includes mechanical switches, that are operated by cams mounted in the hoistway. The assembly spaces the switches at appropriate distances for final slowdown and stopping at the terminal landing to prevent the car from over-travelling in the event the selector fails. The switch signals are monitored by the selector, but are fed directly to the power controller, bypassing the CLC, and will override CLC and selector control in the event the selector or CLC fails or malfunctions. The selector monitors the switch actuation sequence for certain switch failures. Switch assemblies may be provided with switches factory preset for specified application speed, thereby reducing field installation costs.

As noted above, the CLC controls the operation of the power controller during all run conditions of the elevator except final levelling. During final levelling, the CLC enables relays in the power controller so that the controller acts responsive to levelling signals received directly from the selector. During the door operating cycles, the door operator controller operates responsive directly to door edge and electric eye (or other obstruction detecting devices), without going through the CLC, and therefore can respond instantaneously.

The CLC supervises and controls the other subsystems. But, each of the other subsystem has pre-assigned decision making functions that are executed independent of the CLC. In view of the fact that the system includes a number of dedicated microprocessors, the critical control functions for elevator operation are not limited by the power capability of the CLC, or by the time limitations of serial communication between elements.

FIGS. *7a, 7b,* and *7c* are schematic flow diagrams of the operation of the CLC, selector, and door operator in accordance with the invention.

Figure 8:
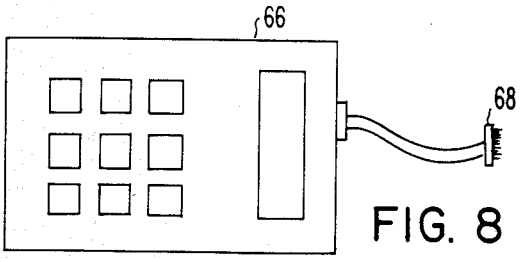
Figure 9:
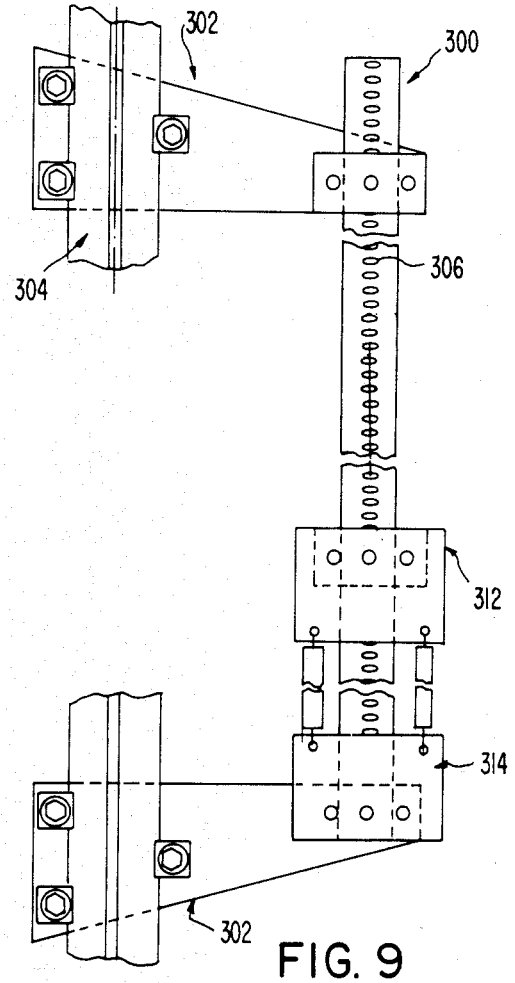
Figure 10:
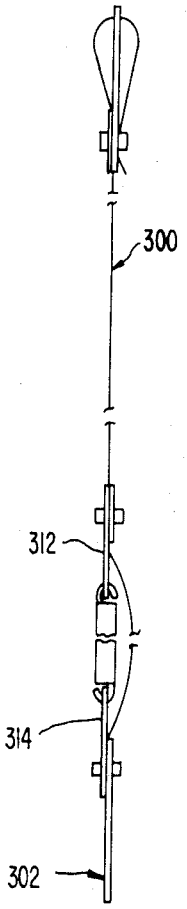
Figure 11:
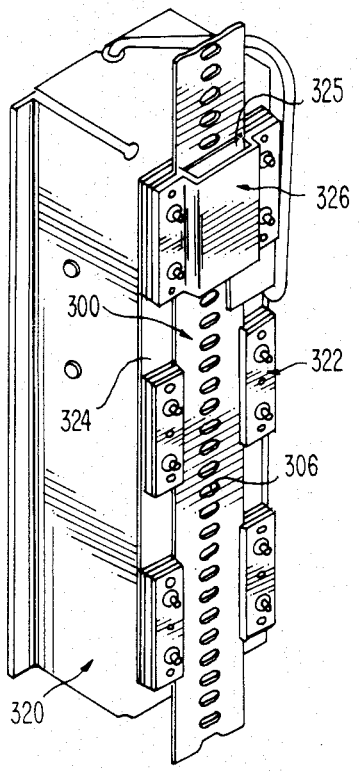
Figure 12:
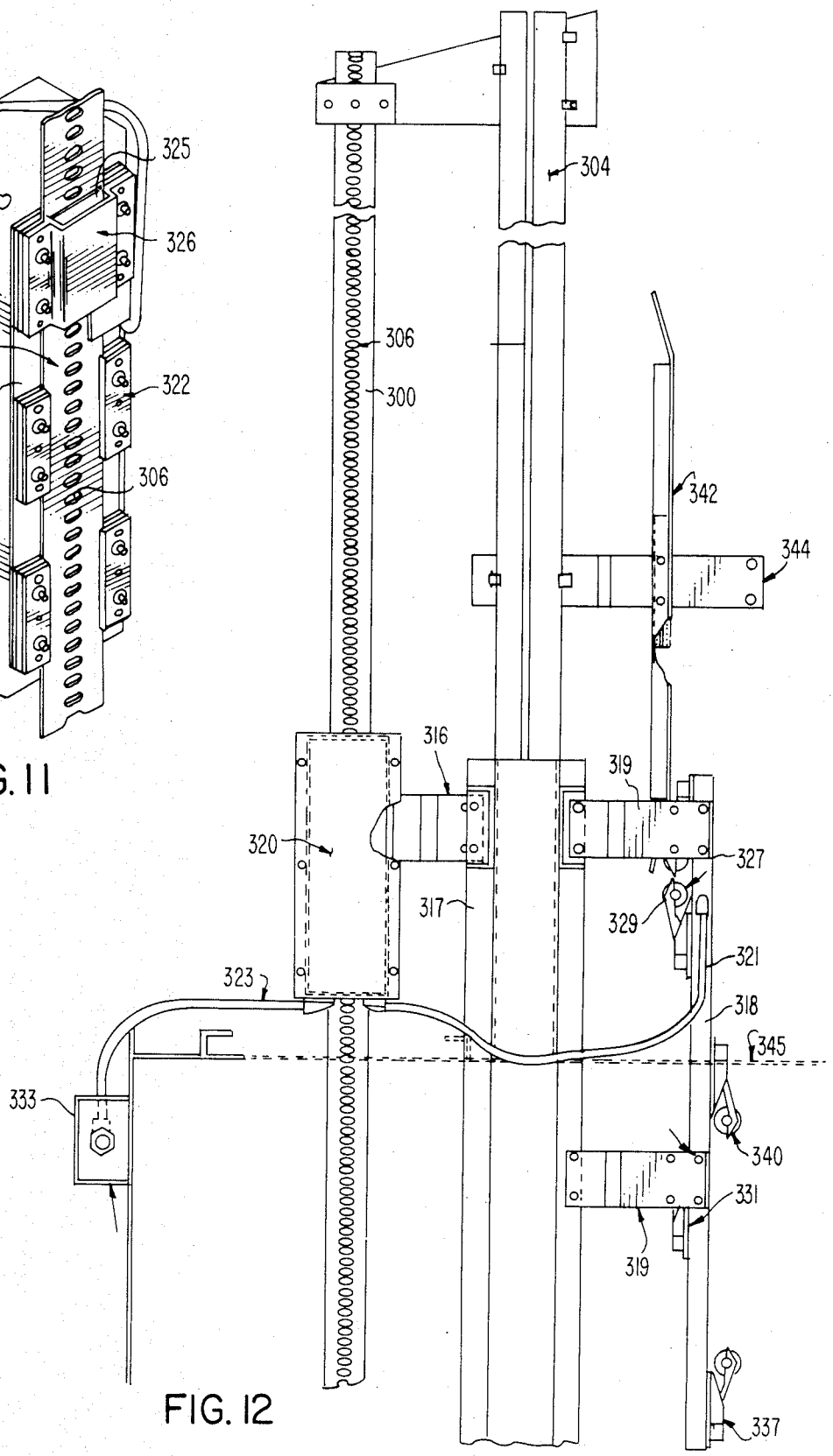
Figure 13:
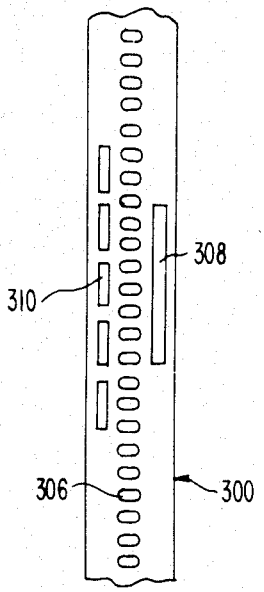
Figure 14:
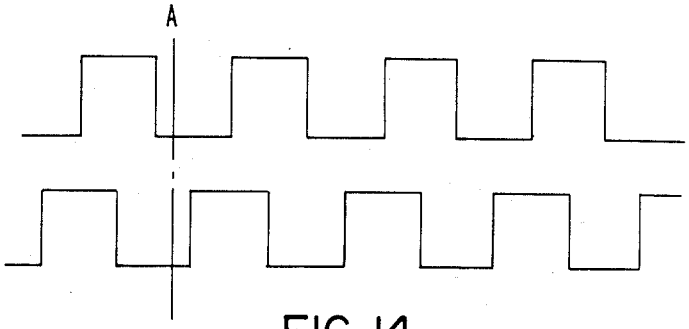
Figure 15:
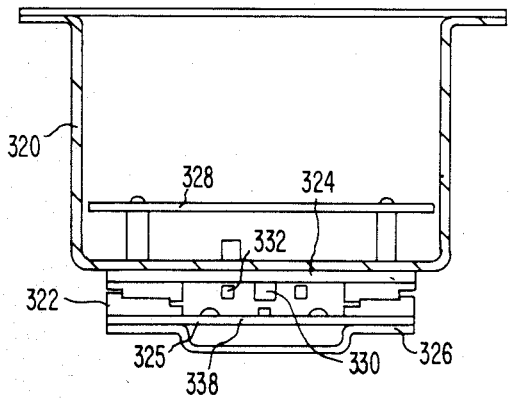
Figure 16:
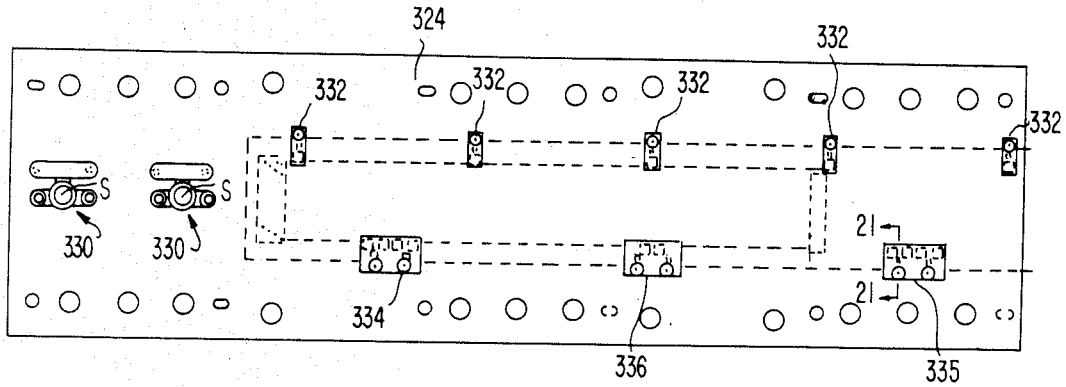
Figure 17:
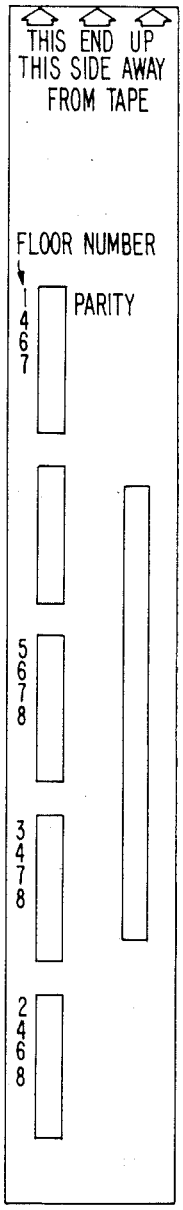
Figure 18:
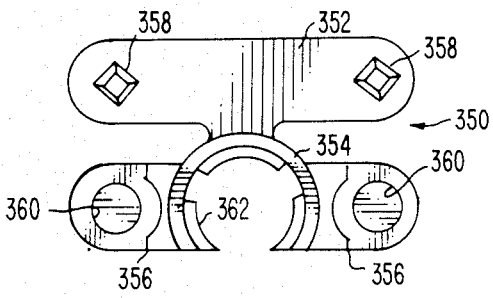
Figure 19:
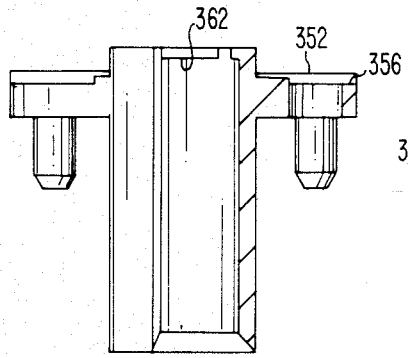
Figure 20:
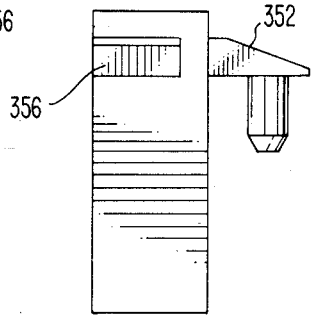
Figure 21:
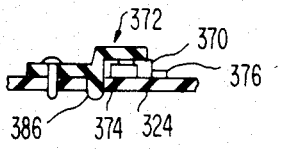
Figure 22:
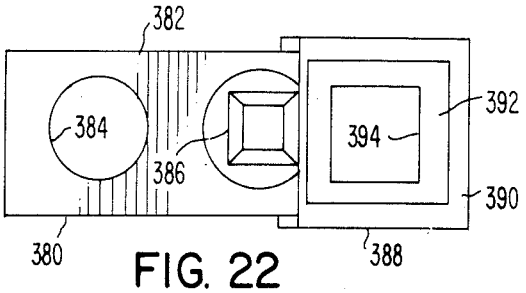
Figure 23:
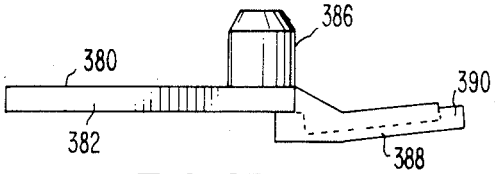
Figure 24:
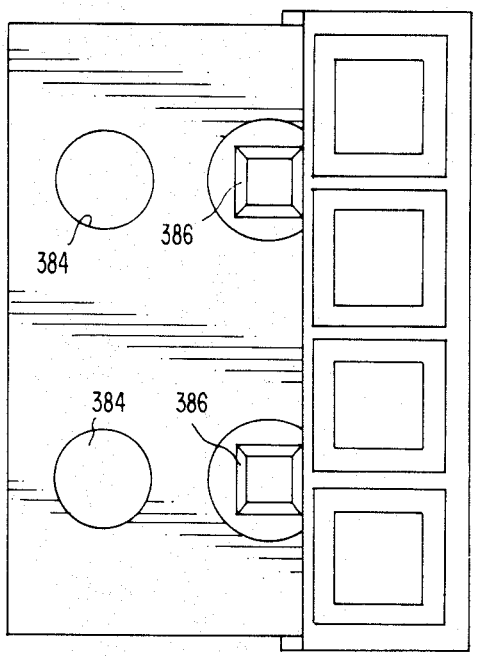
Figure 25:
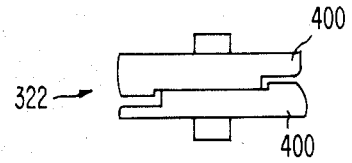

FIG. 8 illustrates a portable terminal for accessing the communications link;

FIGS. 9 & 10 are front and side views of a selector tape in accordance with the invention;

FIG. 11 is a perspective view of a selector housing and selector tape in accordance with the invention;

FIG. 12 is a front view of a portion of the elevator guide rail and selector tape together with the selector housing and switch assembly mounted on the car;

FIG. 13 is a front view of a section of the selector tape, showing an arrangement of magnets for indicating floor position and door zone;

FIG. 14 illustrates the magnetic readouts of a pair of vertically spaced-apart magnetic sensors and positioned to detect the holes of a tape in accordance with FIG. 13;

FIG. 15 is a top view, partially in section of the selector housing shown in FIG. 11;

FIG. 16 is a front view of the sensor mounting board shown in FIG. 15;

FIG. 17 illustrates a novel template for mounting magnets in accordance with FIG. 13;

FIGS. 18, 19 & 20 are bottom, front and side views of a mount for a cylindrical bar magnet used in FIG. 16;

FIG. 21 is a sectional view, taken through lines 21—21 of FIG. 16, illustrating a sensor mount for a hall effect device;

FIGS. 22 & 23 are enlarged bottom and side views of a sensor mount for mounting a single hall effect device, as shown in FIG. 16;

FIG. 24 is a bottom view of a sensor mount for four hall effect devices of the type shown in cross-section in FIG. 21 and also illustrated in FIG. 16;

FIG. 25 is an end view of a selector tape guide pair shown in FIG. 16; and

Figure 26:
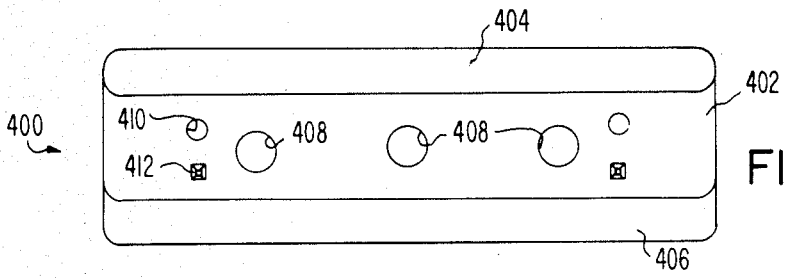
Figure 27:
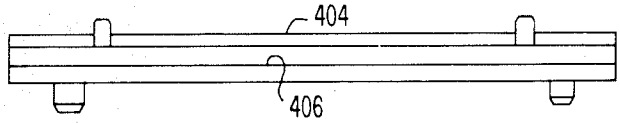
Figure 28:
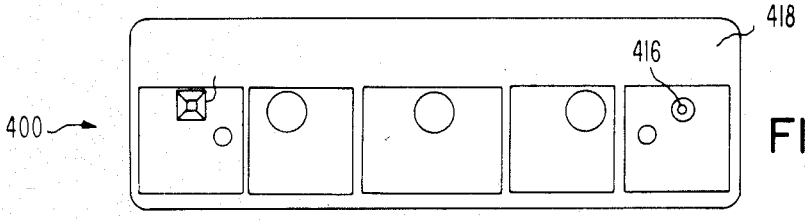

FIGS. 26, 27 & 28 are top, side and bottom views of one of the two identical tape guide pair halves shown in FIG. 25.

DETAILED DESCRIPTION OF A PREFERRED EMBODIMENT

Figure 1:
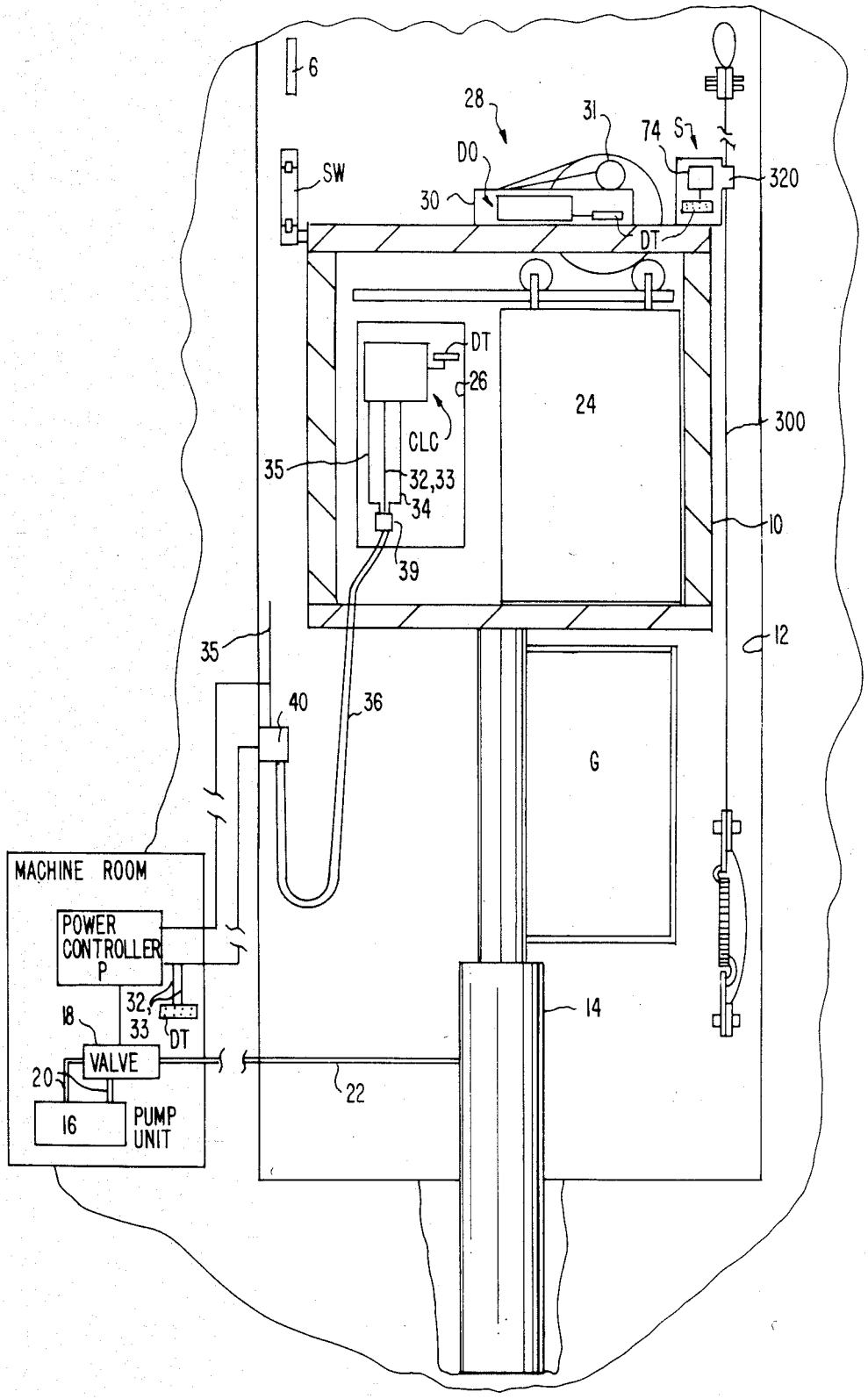
FIG. 1 is a front, schematic view of a hydraulic elevator system in accordance with the invention.

FIG. 1 shows a hydraulic elevator system that includes a car 10 vertically displaceable in a hoistway 12 between landings. One of the hoistway landing doors is indicated at "G". The car 10 is raised and lowered by a hydraulic jack 14, which is supplied with hydraulic fluid from a pump unit 16 through a valve 18. An example of a preferred valve 18 is the I-2 or I-3 Oildraulic® Controller manufactured by Dover Elevator Systems, Inc. The valve 18 includes solenoid-operated valves controlled by a power controller "P".

Oil is supplied from the pump unit 16 to the valve 18 through supply and return lines, indicated by 20, and from the valve 18 to the hydraulic jack 14 by a fluid line indicated by the numeral 22.

The car, shown schematically in FIG. 1, includes a door 24, a swing return panel 26, and a door operator mechanism 28, which includes a door operator housing 30 and motor 31. The motor 31 may be coupled to he door 24 using a conventional pulley and linkage arrangement, or in any other suitable manner. The coupling means, being well known, is only partially shown in FIG. 1.

Elevator operation is controlled by four interconnected subsystems: a car logic controller (referred to herein as "CLC"), which is mounted in the swing return panel 26; a door operator "DO" which is contained in the door operator housing 30; a selector "S", which includes a tape system 300 mounted in the hoistway and a sensor housing 320 mounted on the car, and which also includes a switch assembly "SW" mounted on the car and cams "C" mounted in the hoistway; and, finally, the power controller "P" mentioned above.

Figure 2:
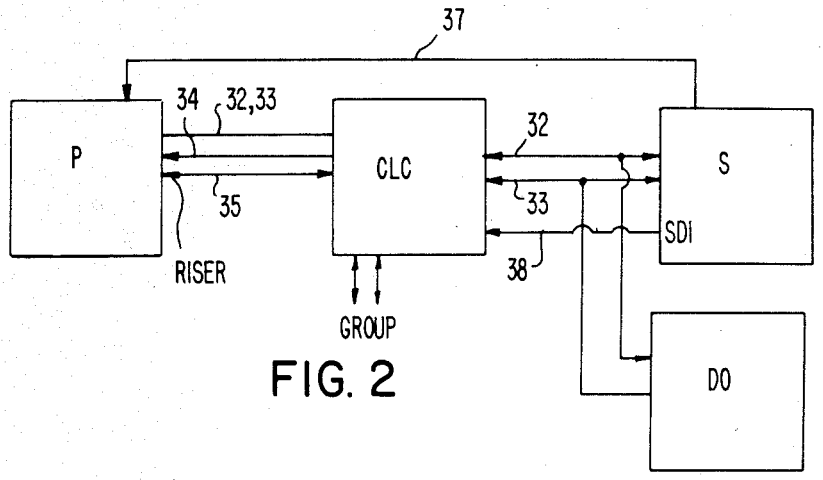
FIG. 2 is a schematic drawing of the control subsystems of the elevator according to FIG. 1.

The elevator system employs a distributed intelligence control, in which the CLC, door operator DO, and selector S have specific control responsibilities. Each includes a microprocessor for performing the designated functions of the subsystem, and also for communication with the other subsystems. The CLC, selector, and door operator microprocessors communicate over a pair of common communication lines 32, 33, as shown in FIG. 2 by way of a serial communications multi-drop link. As also indicated by FIG. 2 the selector "S" may communicate directly with the power controller "P" over communication line 37 as described further below. Finally, selector S communicates directly with an input of the CLC microprocessor over line 38 for providing a slowdown interrupt signal "SDI", also described further on.

An example of a suitable communications interface standard over links 32, 33 is RS485. Each of the microprocessor subsystems has an assigned address and employs suitable RS485 drivers and receivers for sending and receiving signals. The CLC acts as communications controller, and systematically polls the other devices, i.e. it sends out addressed communications and can receive responses within certain time windows. In this manner, other microprocessor subsystems, such as a rear door operator, may readily be connected into the system, requiring only the appropriate software. Also, a portable diagnostic terminal may be connected to the link, and the CLC polls for its presence. As indicated in FIG. 2, the CLC also has a serial output terminals for group operation.

Communication between different devices is accomplished over a twisted shielded pair of wires, preferably using a technique called differential communication, in which one signal is the complement of the other signal. In order for each device in the communication to know who it is talking to, the door operator, selector, car logic controller, and external terminal are each given an address.

Actual communication protocol is arranged in group call packets including a start flag, destination address, source address, type and length information and data field and finally a check sum. This multi-drop, differential RS-485 system ensures reliable communication control.

Referring once again to FIG. 1, a diagnostic tool connector DT is provided physically adjacent to each of the subsystems CLC, DO, the power controller, and S. The connectors DT provide access for an external plug-in device, i.e. a terminal of the type shown in FIG. 8. Standard multi-pin connectors and sockets may be used.

The CLC transmits control signals to the power controller P over a series of wires 34, and receives input signals from the hoistway riser over wires 35. The wires are carried by a travelling cable 36. As indicated by FIG. 1, travelling cable 36 also carries the communications link 32, 33 to the area of the power controller P where it is connected to a diagnostic terminal connector DT. The travelling cable 36 also carries the link 37 from selector S to the power controller. The travelling cable 36, carrying signal links 34, 35 and 37 and communication wires 32, 33, is connected between a terminal 39 in the car and a junction box 40 mounted on the hoistway wall at about the mid-point of elevator travel. The travelling cable 36 also carries current from the power controller P to the car for power supplies associated with the microprocessors, the door operator motor 31, the lights and fan, push buttons, and so on.

Figure 3:
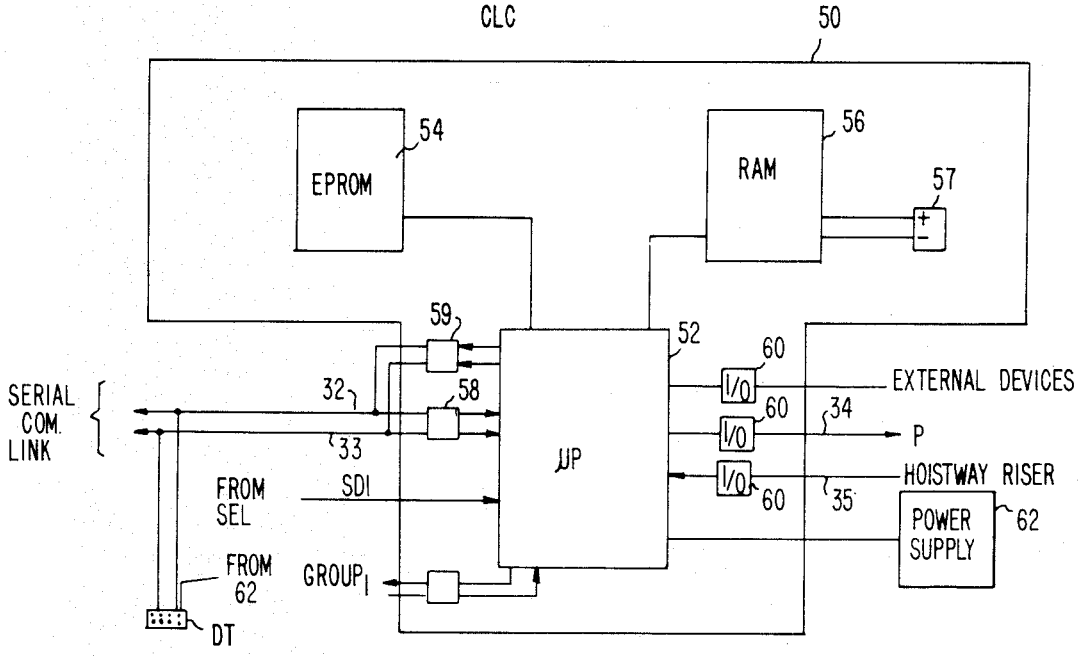
FIG. 3 is a schematic circuit diagram of the car logic controller (CLC)

FIG. 3 illustrates schematically the car logic controller or CLC. The CLC, which is physically located in the swing return 26 (FIG. 1) includes a printed circuit board 50 containing integrated circuits, including a microprocessor chip 52, an EPROM chip 54, memory chips, e.g. RAM 56, and serial interface devices indicated at 58, 59. An example of a suitable CLC microprocessor is a Motorola 6809. Preferably, if volatile chips such as RAM 56 are used for memory, a battery 57 is mounted on the board to retain memory in the event of a power failure or shutdown. The device 58, by way of example, is an RS485 type receiver for inputting signals into microprocessors 52, and device 59 is an RS485 type driver for outputting microprocessor communication signals to the serial communications link 32, 33.

The board 50 also incorporates devices 60, labelled I/O, necessary for the CLC microprocessor to communicate with external devices, such as car call buttons, car signal fixtures, call registered lights (hall lanterns), and hall call buttons (the latter being supplied over line 35 from the hoistway riser), and also to supply output signals over lines 34 to the power controller P. I/O interface devices 60, e.g. for converting voltages, are known.

A power supply 62, mounted in the swing return, supplies power to the CLC microprocessor and can also supply the door operator and selector microprocessors. The power supply 62 gets its power from the power controller over the travelling cable 36.

The portable diagnostic terminal 66 shown in FIG. 8 plugs into any of the connectors DT through pin connector 68. If desired power can be supplied to the terminal 66 from one of the available power supplies, e.g. the power supply 62 or the power controller power supplier (24 VDC), through one of the connector channels in connector DT, to obviate the need for an on-board power supply in the terminal 66. The device 66 is not required when the elevator is in normal operation and is unplugged. Since all of the connectors DT are connected to the common link 32, 33, the CLC, selector, and door operators all may be accessed from any of the locations.

Figure 3A:
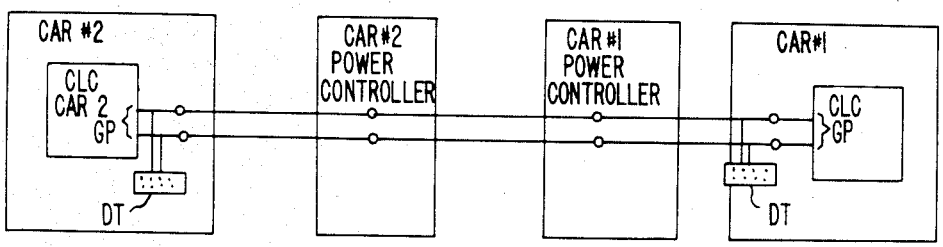
FIG. 3*a* is a schematic circuit diagram of a group operation in accordance with the invention.

Referring to FIG. 3*a*, the CLC in accordance with the invention includes a software section for group operation. In the event the car is to be operated in a group, the second car is connected into a pair of CLC I/O terminals assigned to group operation, preferably by connections made between the power controlless of the two cars as shown in FIG. 3*a*. Communication between cars is preferably via a serial communications link using communications protocol similar to that used among the car microprocessors.

Any microprocessor has a limited ability to address I/O. As will become apparent, in view of using serial communications protocol, and in view of the distribution of control functions (and therefore distribution of control responsibilities of communicating with external devices), the control functions of the CLC utilize a relatively small number of I/O parts, and leave free terminals for performing other functions such as safety and fault monitoring. Distributed control with serial communications therefore reduces I/O cost and space requirements.

Figure 4:
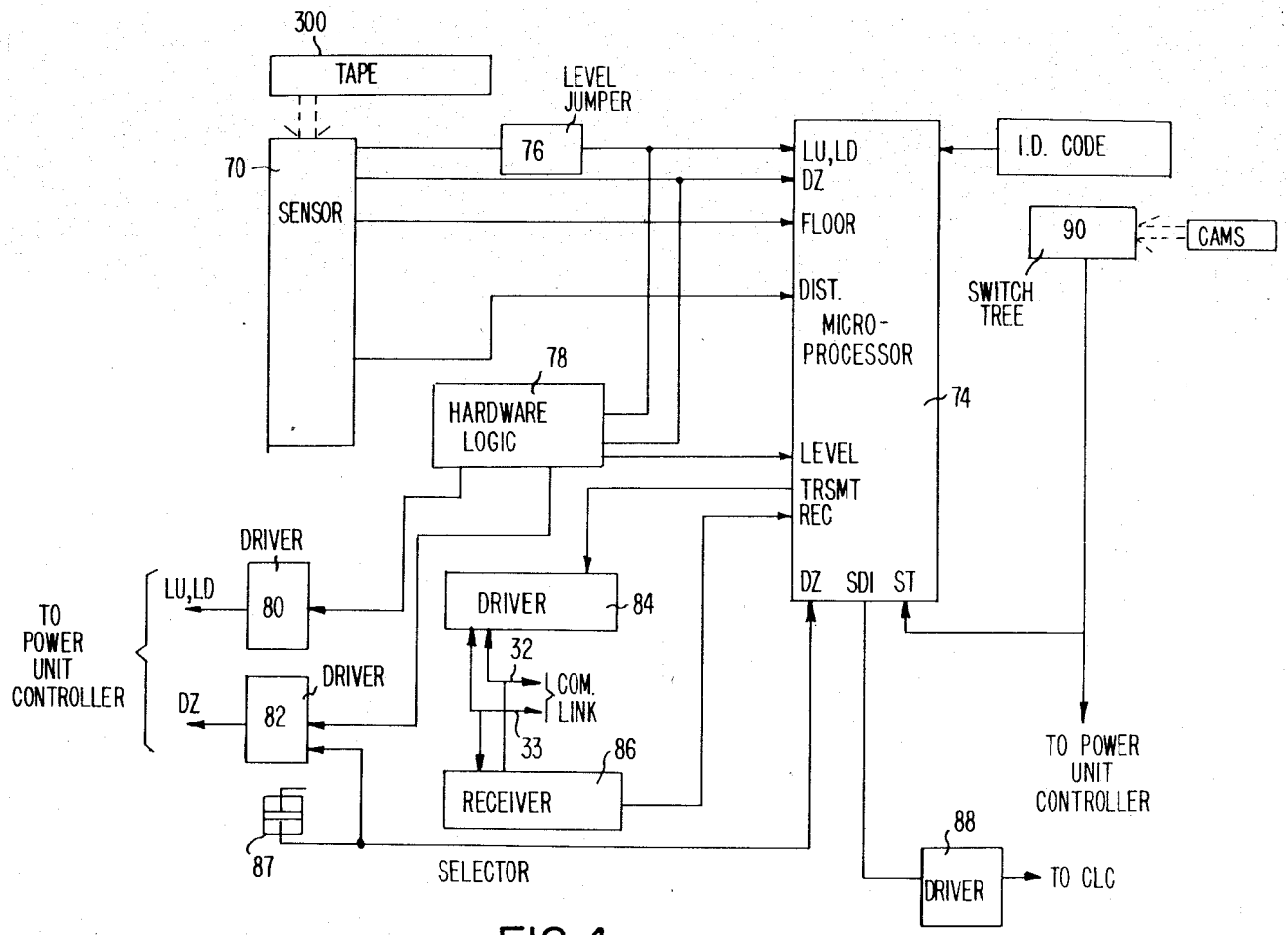
FIG. 4 is a schematic circuit diagram of the selector.

The selector S is illustrated schematically in FIGS. 1 and 4. The selector subsystem is a microprocessor-based control that provides signals for slowdown, levelling, and position as well as diagnostics for fault conditions. As indicated in FIG. 1, the selector subsystem includes three functional components: (1) the tape system (which comprises a stationary tape 300 and a sensor housing 320); (2) a switch device "SW" with cams "C", and (3) a processor board 74. An example of a microprocessor suitable for a use with a selector in accordance with the invention is the Motorola Model 68701, which includes on-board, programmable memory.

All of the selector active components are mounted on top of the elevator car, which reduces hoistway wiring. The mechanical configuration of each of these components is described further on.

The tape system includes a sensor 70 that derives three sets of signals: levelling, floor position, and relative travel distance. More specifically, the sensor 70 derives the following signals from the tape 300: door zone DZ, indicating that the car is within a specified distance of the landing; level up LU, which indicates the car is in a region just below the landing; level down LD, which indicates the car is in a region just above the landing; floor position, which may be read as binary code signals, and relative travel distance, which may be pulses representative of travel.

LU and LD sensors are activated when the car drifts a certain distance away from the landing. The distance the car can drift without activating the LU or LD sensor is called the dead zone. Preferably, a plurality of level up LU and level down LD sensors are provided at different spacings, and a pair of LU and LD sensors are selected dependent upon the desired dead zone. A levelling jumper selector 76 may be used to select which pair of sensors are to provide the LU and LD signals.

DZ, LU, LD, floor position, and travel pulse signals are fed as inputs to the microprocessor 74. The door zone DZ, level up LU, and level down LD signals are also provided through a hardware logic device 78 to a pair of drivers 80, 82 which transmit such signals to the power unit controller P. The hardware logic device 78 decodes the levelling and door zone signals to produce a level signal to the microprocessor when the car is level. The device 78 buffers these signals for the drivers 80 and 82.

Signals from the CLC are received in an RS485 receiver 86 over communications link 32, 33, and provided to an input terminal of the microprocessor 74. A microprocessor output terminal is connected to the output driver 84 for providing output to the communications link 32, 33.

The selector hardware also includes a Reed switch 87, which provides a door zone signal. The Reed switch 87 signals are provided to a microprocessor input, and also to the driver 82 for transmission to the power controller. The Reed switch signal is a duplicate of the door zone signal DZ received from the sensor 70 and is used as a backup.

Another output of the selector microprocessor 74 provides an output signal "SDI" for slowdown interrupt. This signal, which represents the slowdown point for the elevator car during a run, is provided to a driver 88 which transmits the signal to an input of the CLC.

The switch assembly 90 includes a plurality of switches, which are actuated by cams mounted in the hoistway indicating that the car is near the top or bottom of the hoistway or has over-traveled the final hoistway landing. A first switch (terminal slowdown) actuates at slightly less (1–2 inches) than the slowdown distance from the terminal floor. A second switch (directional limit) actuates about 1–2 inches beyond the terminal floor. The switch output signals are provided as an input to the microprocessor 74 for diagnostics, for example, to be stored as a "fault", which can later be read by the diagnostics terminal 66 during elevator servicing, and also routed to the power controller P.

The selector of FIG. 4 includes appropriate circuit protection devices, as well as devices for converting voltages, etc. which are known components and have been omitted for clarity. Also, as indicated on FIG. 4, the processor 74 includes an input terminal for providing an identification code, which is used to assign an address to the microprocessor for communicating over the communications link 32, 33.

Figure 5:
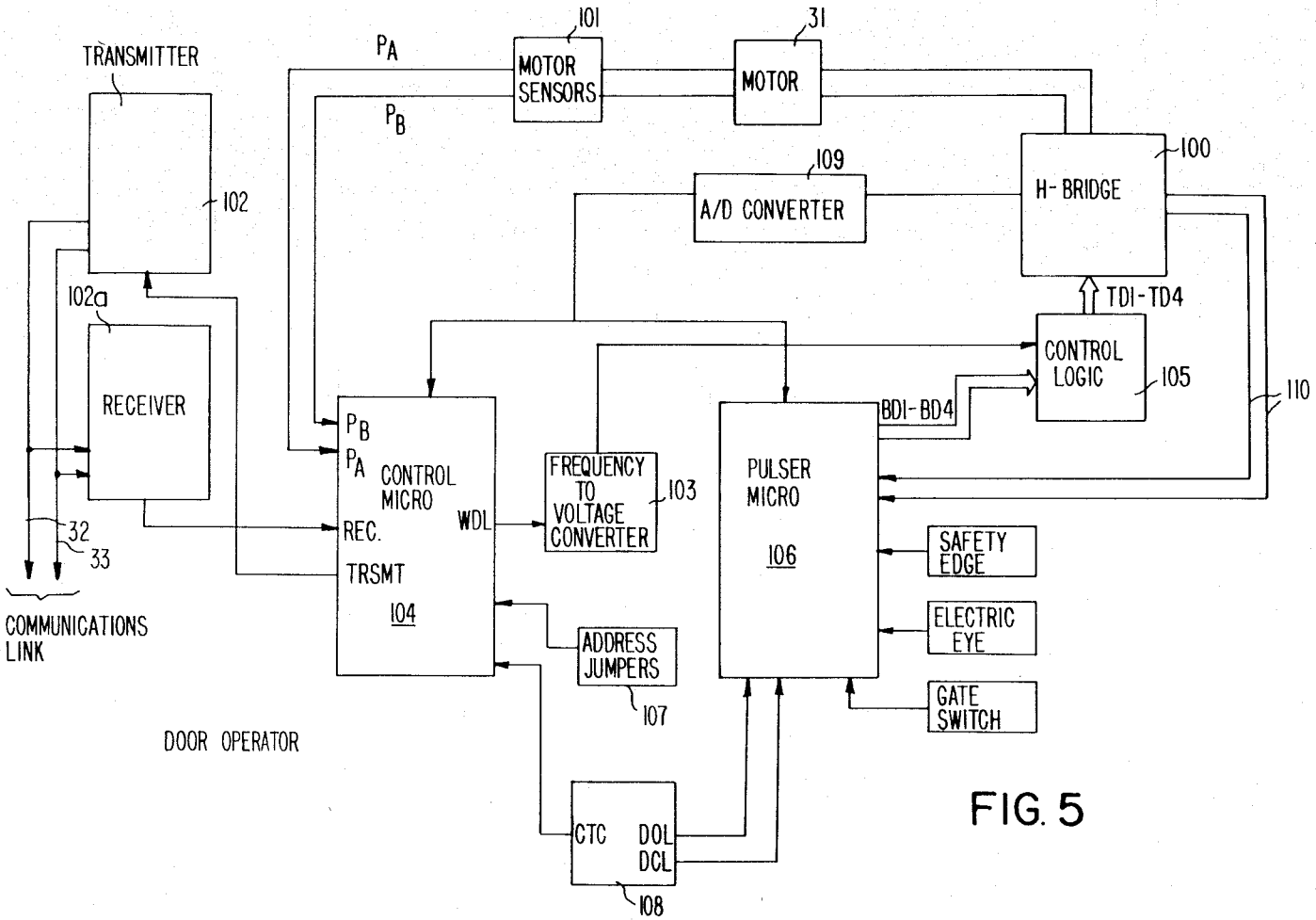
FIG. 5 is a schematic circuit diagram of the door operator.

FIG. 5 is a schematic circuit diagram of the door operator, which includes a door operator motor 31 as shown in FIG. 1. The motor is controlled by an H-bridge control 100, which includes diagonal pairs of transistors that are turned on and off selectively, depending upon the desired output voltage and direction of rotation.

The door operator includes a pair of microprocessors, control microprocessor 104 and pulser microprocessor 106, each of which may be Motorola Model 68701, with on-board, programmable memory. The control microprocessor 104 communicates with the CLC through an RS485 driver 102 and receiver **102*a*, that are connected to serial link 32, 33. A communications address is assigned to microprocessor using address jumpers 107**.

Pulser microprocessor 106 includes outputs for supplying control signals BDl through BD4 to a control logic device 105. Control microprocessor 104 also has an output connected, through a frequency-to-voltage converter 103, to control logic device 105. The control logic device buffers the BD1–BD4 signals to the H-bridge 100 and will inhibit them if the voltage from the converter 103 is too low, a low voltage being indicative of improper operation of the microprocessor.

Control microprocessor 104 monitors for proper operation of the pulser micro 106 through communications over an 8 bit parallel bus that connects the two micros and an analog-to-digital converter 109. The control logic output WDL from control micro 104 is a constant frequency square wave signal that indicates proper operation of the two microprocessors. This square wave signal is applied to a frequency-to-voltage converter 103 to change it into a steady state active high logic signal. If the frequency from 104 is greater than a preset value, e.g. 400 hz., an active high signal, CONTROL, is applied to control logic device 105 to allow the signals BD1–BD4 to be passed through to the H-bridge control 100 as signals TD1–TD4. If the signal WDL stops switching or drops below the preset value, the signal CONTROL will go low and the bridge control signals BD1–BD4 will be removed from the H-bridge.

Any failure that allows the bridge control signals BD1–BD4 to stop switching properly and be applied to the bridge steady state will cause the door to move out of control. Having one micro monitor the other and using a square wave signal applied to a frequency to voltage converter provides for a fail safe watchdog circuit that will activate for either a active low or active high failure of the micro output.

Motor sensors 101 generate output pulses Pa and Pb, representative of rotational movement of motor 31, which are supplied to input terminals of the control microprocessor 104. Devices for generating output pulses responsive to motor rotation are known. The analog-to-digital converter 109 is connected to the H-bridge 100 by sensing voltage across a resistor in the bridge and supplies output signals representative of motor current to the control micro 104 and pulser micro 106 for the purpose of limiting the maximum torque of the motor and hence force of the door based on preset limits.

The analog-to-digital converter 109 is connected to a resistor in the H-bridge. All motor current passes through the current sense resistor. The a/d converter 109 converts this current, that represents torque applied to the door, into a digital number. This digital number is made available to both micros 104 and 106 through the 8 bit parallel bus. This current feedback is used to limit the maximum torque of the motor and hence force of the door as dictated by the elevator code. The value of closing torque may be preset in the microprocessor, using the diagnostic tool 66.

A switch array 108, which is responsive to the movement of the car door, provides three signals: door open limit DOL, door closed limit DCL, and door center travel check CTC. DOL and DCL signals are provided to the pulser microprocessor 106. CTC signals are input to the control microprocessor 104.

The pulser micro 106 can also monitor other signals representative of the operating states of the door system circuitry, such as monitoring the status of the H-bridge through feedback inputs 110.

The I/O section of the door operator pulser microprocessor 106 connects the logic section of the board to peripheral devices, which are the electric eye, safety edge and gate switch.

Figure 6:
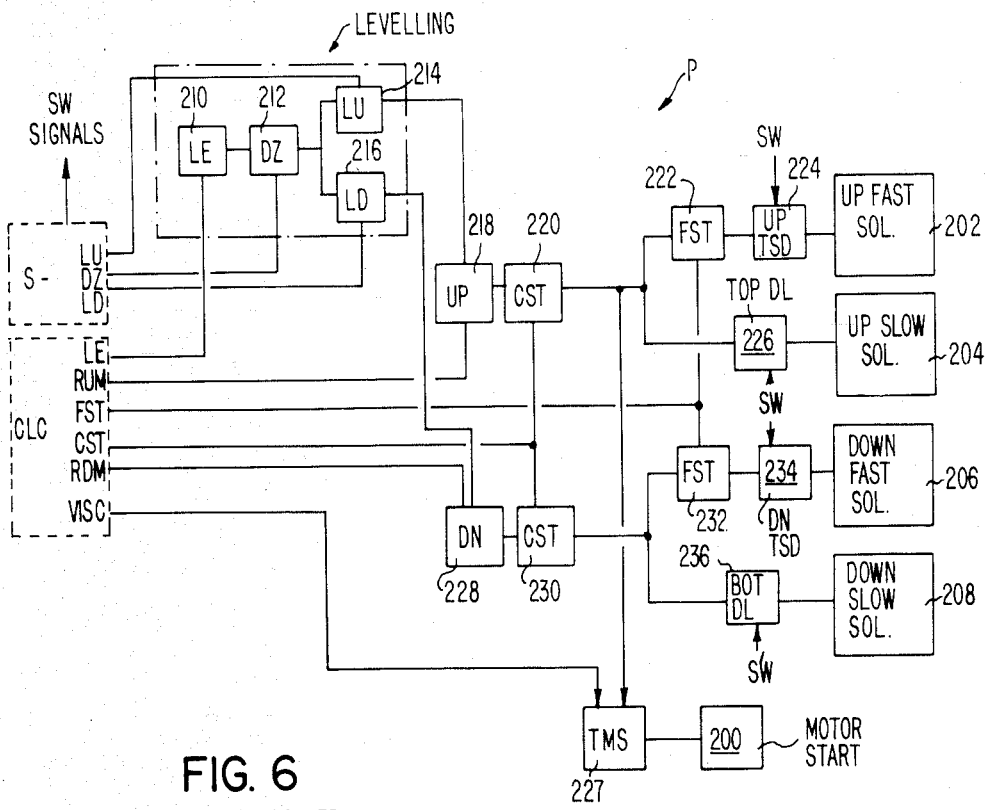
FIG. 6 is a schematic drawing of the power controller.

FIG. 6 illustrates schematically one example of a power controller P which, as shown in FIG. 1, is located in the machine room adjacent to the pump unit 16. The controller P contains relay logic circuitry for controlling, responsive to signals from the CLC and selector and safety circuit, the pump motor starter 200 and four solenoids contained in the hydraulic valve 18, that regulate the flow of hydraulic fluid to the jack: an "up fast" solenoid 202, and "up slow" solenoid 204, a "down fast" solenoid 206 and a "down slow" solenoid 208.

The power controller P is basically divided into levelling circuits and up and down run circuits. The levelling circuits include a level enabler LE relay 210, a door zone DZ relay 212, and level up LU and level down LD relays 214, 216. LE relay 210 is enabled by a level signa LE from the CLC; DZ, LU and LD relays 212, 214, and 216 are enabled by LU, DZ, and LD signals from the selector.

The up run circuit includes an up relay 218, a normally closed car stop interrupt relay 220, a fast FST relay 222, an up terminal slowdown relay 224, a top directional limit TOP DL relay 226, and a TMS (timer-motor-starter) relay 227.

The down run circuit includes a down relay 228, a car stop CST relay 230, a fast FST relay 232, a down terminal slowdown DNTSD relay 234, a bottom directional limit BOT DL relay 236.

The CLC provides control signals "run up" RUM to enable the up relay 218, "fast" FST to enable the FST relays 222, 232, "car stop" CST to open the normally closed CST relays 220 and 230, and "run down" RDM to enable down relay 228. CLC also outputs a viscosity signal VISC to actuate TMS relay 227.

The power controller P will normally include interlock relay circuitry, made up of the hoistway door interlocks, and safety circuitry made up of the pit safety switch top and bottom and the final limits, power unit stop switch and crosshead stop switch, that prevents the car from executing a run under certain conditions, e.g. when the doors are open. Such circuiting is used in known relay-based systems and is omitted from FIG. 6 for clarity.

As indicated in FIG. 6, signals from the switch assembly SW indicative of top directional limit, bottom directional limit, and up and down terminal slowdown points are fed from the selector to an up terminal slowdown relay 224, a top directional limit relay 226, a down terminal slowdown limit 234, and bottom directional limit relay 236. Alternatively, signals from the switch assembly may be connected to switches in the power control circuit to act on the circuit directly.

SYSTEM OPERATION

Car Logic Controller

The CLC acts as the central controller for the system. During all operations except levelling, the LE signal is off and the CLC controls the up and down run of the power controller.

Referring to FIG. *7a*, in operation of the elevator, hall calls and car calls are inputed into the CLC, which latches the call and provides an output to the call registered lights. If the doors are open, the CLC dispatches a closed door signal to the door operator. Once the doors are closed, the CLC then issues a command to the selector to step up or down.

Once the step up/down signal is received by the selector, and the level command is removed, the door operator locks the doors. The selector advances the target floor to the next floor and transmits the new target floor to the CLC. If a stop has been requested at the target floor, the CLC removes the run signal. If a stop signal has not been issued, the car continues to run, and the selector issues a late car refusal signal, at the last chance to stop, to the CLC. The selector then advances the target floor and the process is repeated.

If a stop has been requested at the target floor, the selector sends the interrupt signal SDI at the slowdown point to the CLC over a separate interrupt line. As noted above, the normal communication between microprocessors is by way of polled network. It takes on the order of 200 milliseconds to complete a poll. However, in the case of the stop signal, the CLC immediately removes the fast solenoid signal, disabling the FST relays 222, 232. As soon as the car activates the level up indicator, the CLC relinquishes solenoid control to the hardware levelling circuits in the power controller, by removing the RUM signal and enabling the LE relay 210. Final levelling is then done by the power controller P and selector.

When the car is level, the selector S issues a level command to the CLC, and the CLC then permits the doors to open.

The CLC is programmed to retain in memory certain operating parameters of the elevator system such as door open times, automatic recall timeouts, fire service landings, etc. Preferrably, the CLC, as well as the other controls subsystems, also monitor system operations through the I/O inputs and store elevator faults when detected. Providing external access, such as through input 64, permits faults to be read for troubleshooting purposes, and permits operating parameters to be set and modified externally.

During elevator setup and adjustment, certain parameters may be selected and input into the system for storage. Preferrably such parameters are stored in a battery-backed RAM 56 with the battery 57 mounted on the CLC board. When power fails, or is intentionally turned off, the elevator settings will be retained in the battery backed memory, and when power is restored, the microprocessor is programmed to look to this location for operating parameters. Default settings are stored in the EPROM 54, which settings also are used for initial elevator setup.

SELECTOR

The selector microprocessor includes a program for retrieving floor height distances and slowdown distances stored in memory, setting target floors responsive to CLC commands and movement of the car, of determining car distance from the target floor landing, determining direction of elevator travel, and issuing slowdown and level signals to the CLC.

During elevator setup, the selector counts distance pulses between floors during an elevator run and stores in memory. Also, the slowdown distance is input into memory through the portable diagnostic tool 66. Other parameters, such as number of floors, are also programmed into memory with the external diagnostic tool.

Referring to FIG. *7b*, when stopped at floor, the target floor and the actual position are the same. The selector checks for level and, if the car is level, issues a level signal to the CLC. When the CLC receives a call, for example an up call, it issues a step up command to the selector for running up. When the selector receives this it checks the safeties. If the safeties are safe, it advances the target floor, removes the level signal and issues "fast" FST and "run up" RUM signals to the CLC. The selector also retrieves floor height distance from memory, to use as the initial target distance, and checks the preset slowdown distance and late call refusal, LCR distance. As the car moves up, the selector counts pulses to update target distance, and checks to determine if the car has reached the late call refusal, LCR distance. If it has reached LCR for the target floor, the selector advances the target floor to the next floor and calculates a new target distance, by adding the next floor height to the preset target distance. If it has not reached late call refusal, the selector checks the CLC to see if there is still a go up command. If the go up command has been removed (indicating a stop request at the target floor), the selector checks for the slowdown point for the floor. When the car reaches the slowdown distance, the selector issues the SDI slowdown command to the CLC and removes the FST command to the CLC. As the car continues to move toward the floor (i.e. slowing down), the selector checks for the door zone signal DZ. When DZ is reached, it removes the RUM to the CLC and waits for the car to level to dead level. At dead level, it issues the level signal to the CLC and the sequence starts over. The same sequence takes place for a down run except, the RUM becomes RDM and the "ups" become "downs".

During the above sequence, an ISR interrupt can request the processor to service the pulse count routine.

This routine is very fast and the processor quickly returns to the above sequence.

The information for slowdown, levelling, and position is provided by a tape system. The safety and code compliances are provided by the switch assembly switches mounted on the car and actuated by rail-mounted cams at the terminal locations. The selector board monitors all of this and provides the appropriate signals to the power controller and the CLC.

Preferably, the selector is programmed to self-correct the set slowdown distance based upon prior elevator runs. By way of example, during elevator setup, preferably the installer sets a slowdown distance value so that the elevator neither overshoots nor undershoots the landing. At such time, the selector calculates the slowdown time under the adjusted conditions. Thereafter, during elevator runs, should the slowdown time increase or decrease, which is indicative of changes in viscosity in the hydraulic fluid, the selector automatically adjusts the slowdown distance to compensate for the difference in slowdown time.

Alternatively, the selector can determine the distance from the landing at which landing speed has been reached. In the case of overshoot, the selector can determine the distance from the landing at which the car has stopped. Should the car undershoot the landing, it will not stop, since the slow solenoid is still actuated, but will travel in at a minimum speed. The selector, since it calculates speed, determines the distance from the landing when the elevator reaches a predetermined minimum speed, and can make corrections based thereon.

DOOR OPERATOR

Figure 7A:
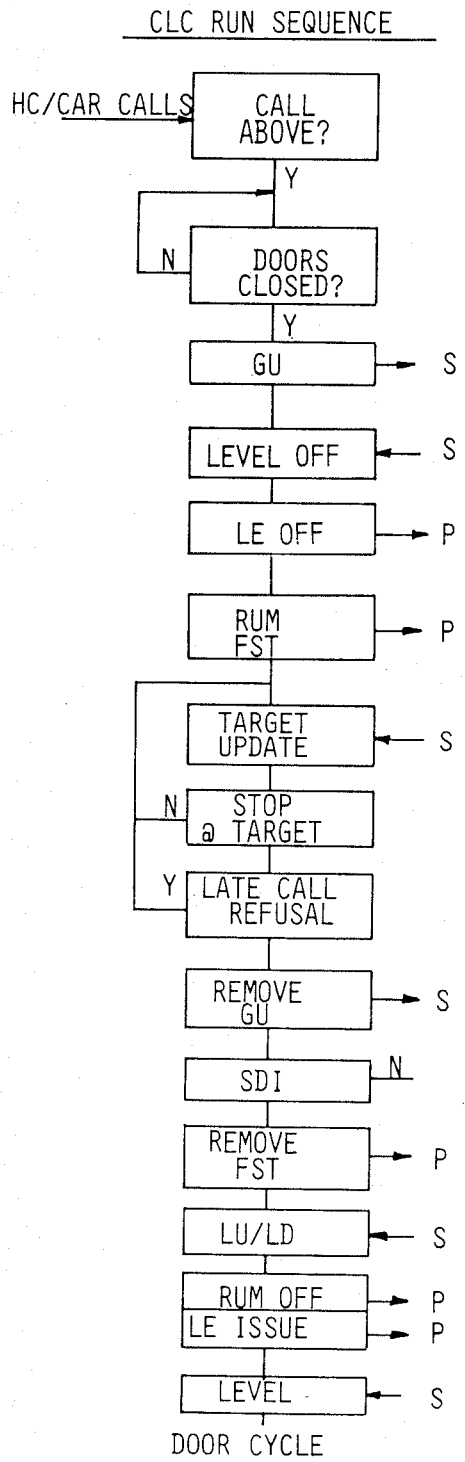
Figure 7B:
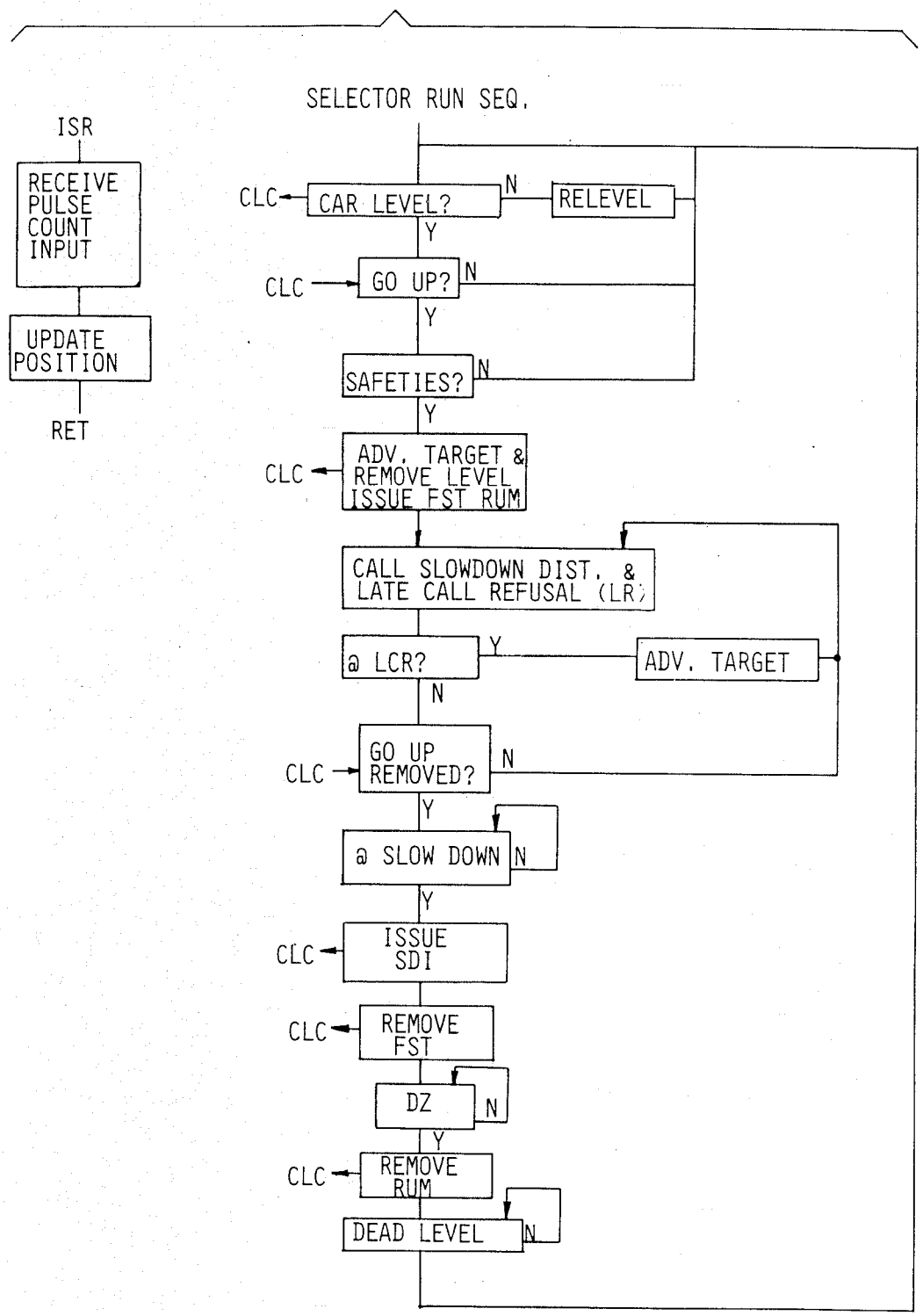
Figures 1, 7C:
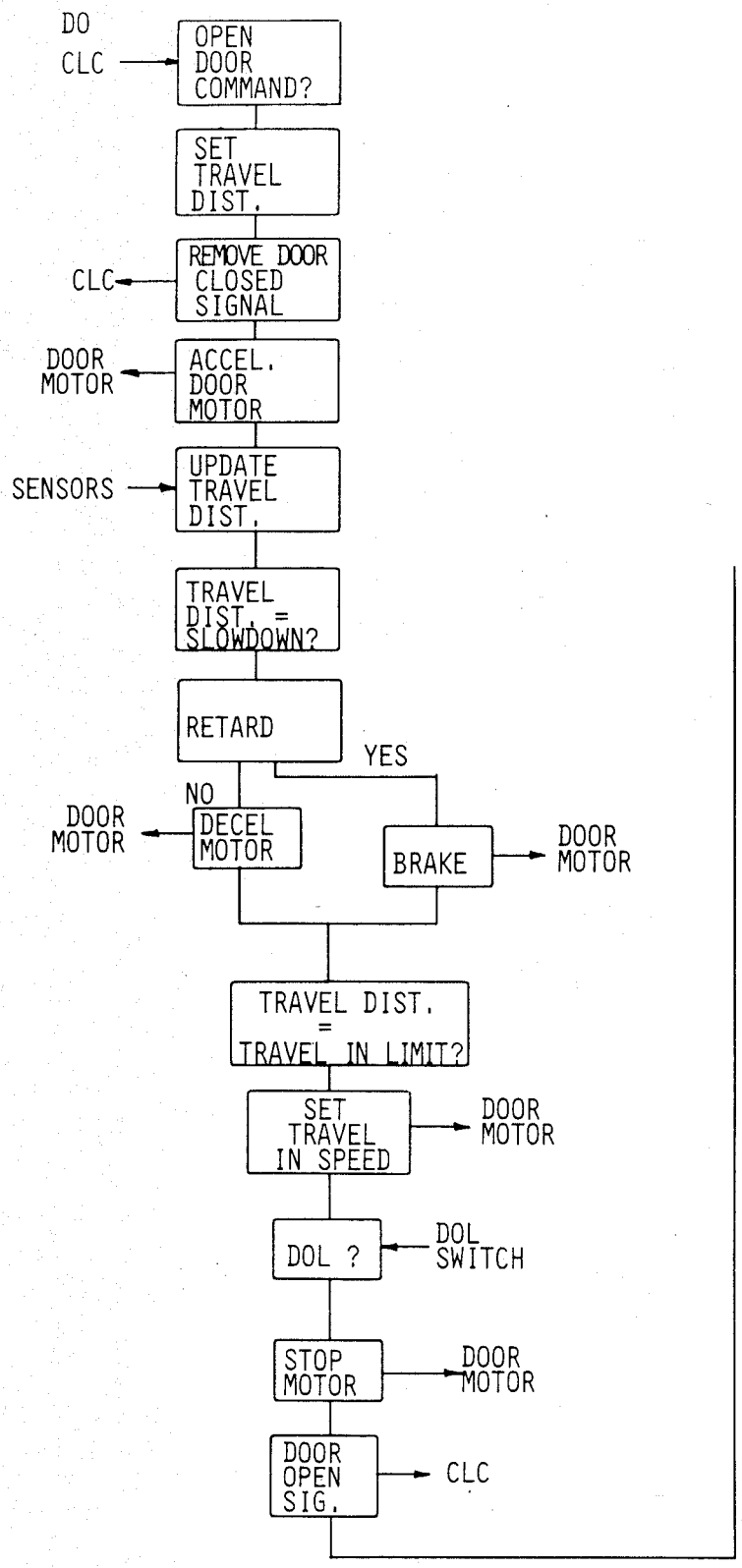
Figures 2, 7C:
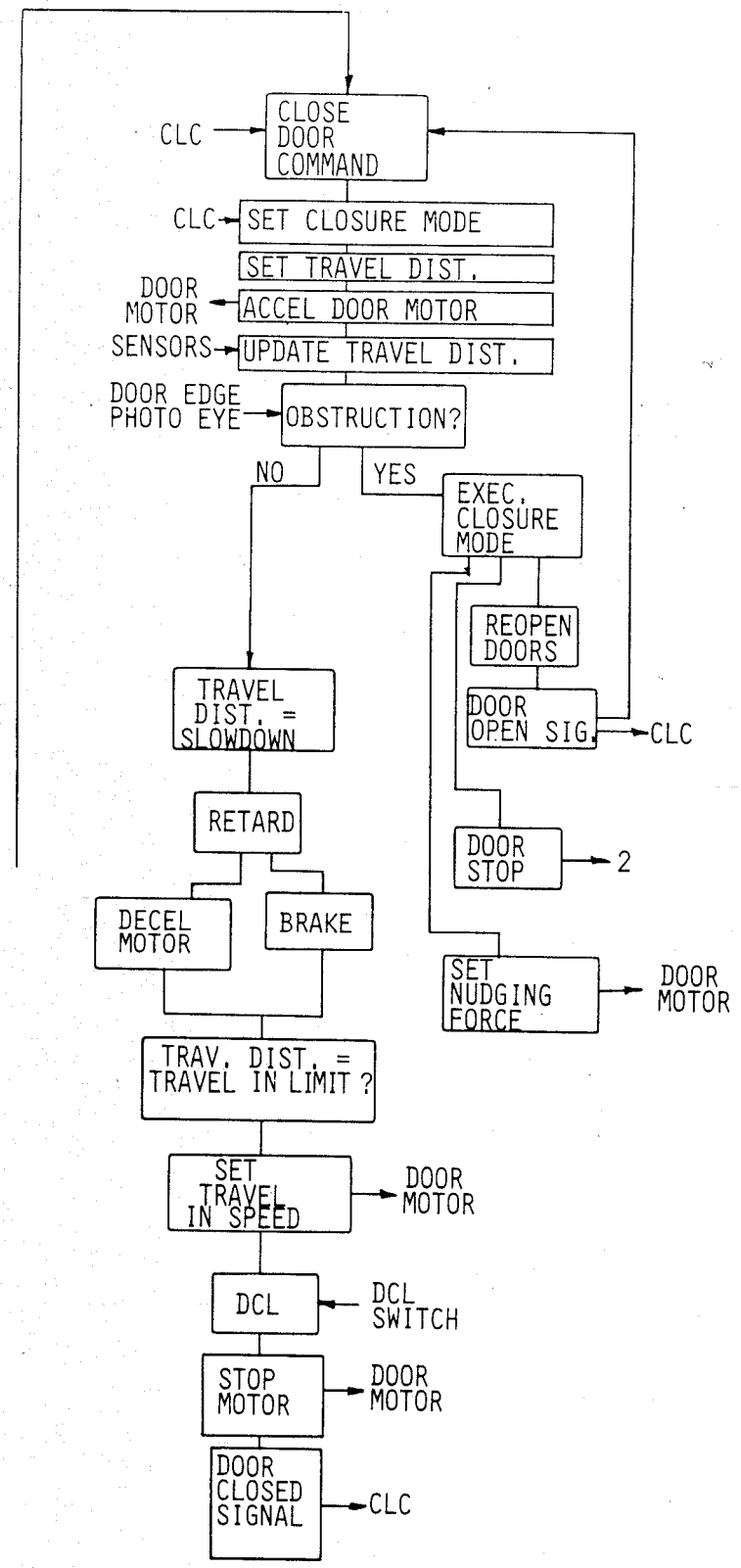

Operation of the door operator is as follows, with reference to FIG. 7*c*. Upon receiving a "door open" command from the CLC, the control micro 104 issues a command to the pulser micro 106 to initiate a door open cycle.

The pulser micro 106 outputs signals BD1–BD4 in the proper pattern for open, and with the duty cycle to generate the speed dictated by the control micro 104. All speeds and positions are retained in the memory of control micro 104 and the CLC and are programmed during elevator setup with terminal 66.

The control micro 104 instructs the pulser micro 106 to begin ramping up door open speed at a controlled programmed rate until open high speed is reached. As the motor rotates, pulse signals PA & PB from motor sensor 101 are provided to control micro 104, which decrements the door travel distance, until it reaches the slowdown point. The control micro instructs the pulser micro 106 to begin ramping down the door open speed at a controlled rate until the door reaches a programmed "travel-in" point, whereafter the motor moves at a preset travel-in speed until reaching the door open limit. An alternate slowdown mode is available that applies reversing power (retard) on the motor until the speed is reduced to a preset manual speed at which time the door continues at manual speed until reaching the door open limit. Once the door open limit is reached, pulser 106 stops the motor.

The normal deceleration, as mentioned above, linearly decreases the speed from the slowdown point until the travel-in point. Then the door continues at manual speed.

The CLC determines the length of time the door will remain open, which is usually shorter for passengers leaving the car than when passengers are entering (i.e. shorter when the car is responding to a car call than a hall call). The CLC issues "close door" commands. It also instructs the door operator as to closure mode. The door closes according to the same algorithm as above, except if one of the safeties is actuated. Should this occur, the pulser micro 106 reaction depends on the mode of operation. In normal mode the pulser immediately stops the motor and reopens the doors. In another mode, the pulser stops the motor but does not fully reopen the doors. In a third mode, the pulser ignores the photo-eye and closes the door under a specified amount of closing force, i.e. a "nudging" operation. In either event, the stopping mode is preselected by the CLC, and the closing cycle is executed independent of the CLC. The control micro signals the CLC when the doors are closed and the gate relay is activated.

POWER CONTROLLER

As discussed above, the power controller comprises relay circuitry which is under the control of the CLC, except during levelling operations and with the exception that certain safety devices can override the CLC control.

In order to make an up run, the CLC issues a run up command RUM, which actuates the up relay 218, and also issues a fast signal FST, to activate the FST relay 222. Under normal operations, the car stop signal CST is off, and therefore the CST relay 220 is closed. Also, under normal conditions, the up terminal slowdown switch and up top limit switches are not engaged, and therefore relays 224 and 226 are closed. As a result, the run up and fast signals from the CLC energize both the up fast solenoid 202 and the up slow solenoid 204, and the car begins a full speed run up. When the car reaches the slowdown point for landing, the CLC removes the fast signal, disabling the up fast solenoid 202, and the car begins to slowdown. As the car approaches the floor, the selector door zone sensor is actuated by the door zone magnet, and the selector signals the CLC that the car is within levelling distance. Thereafter, the CLC issues the level LE signal, to actuate the LE relay 210, and removes the run up signal RUM. The up relay 218, however, remains energized, because both the level up LU and door zone DZ relays 212, 214 are actuated. As soon as the car is level, and the LU signal ceases, LU relay is deactivated, deactivating up relay 218 and stopping the car at the landing.

When the up relay 218 is activated, an output signal energizes TMS relay 227, starting the motor. The TMS functions to keep the pump motor operating slightly longer than the car is moving, which allows the car to make a valve-controlled stop and not a motor starter stop.

When the car is parked at a landing and level, the door zone relay remains energized. Should the car move more than a predetermined distance away from the landing, the selector will issue either a level up LU signal or level down LD signal, which will activate one of the relays 214 or 216, causing the car to level up or down.

In practice, in order to run up, in addition to the RUM signal from the CLC, the interlock relays, connected to hoistway doors and gate, must be energized in order to permit the car to move.

A viscosity signal from the microprocessor may also start the TMS timer and motor starter, in order to maintain a desired minimum oil temperature. In the past, it has been necessary to maintain the hydraulic oil within specified temperature limits to ensure accurate running of the elevator. In this operation oil circulates in a bypass mode, being heated in the process. In an elevator system having a selector that corrects for changes in oil viscosity, as described above, it is not necessary to provide a viscosity signal for heating the oil, except in the case of extreme temperature variations, and a considerable amount of energy can be saved.

If a car is running up and opens the up terminal slowdown, the up terminal slowdown switch will disable the up fast solenoid, permitting the car to run up only on the slow solenoid. If the car should thereafter move to the top directional limit, the top directional limit relay will disable the up slow solenoid preventing any further upward car movement. The up and down slowdown switches which are switches mounted on the car, slow down and stop the elevator near the top and bottom terminal landings independent of the selector function.

SELECTOR CONSTRUCTION

FIGS. 9–28 illustrate a particularly advantageous form of a selector system for use in connection with a microprocessor-based elevator system. Referring to FIGS. 9 and 10, a selector tape 300 is mounted vertically in the hoistway. As an example, the tape 300 may be mounted on brackets 302 attached to one of the elevator rails 304 at the top and bottom of the hoistway. Preferably, the tape is made of steel and is approximately 3 inches wide. The tape 300 includes a series of laterally elongated holes 306 spaced vertically along the hoistway. Referring to FIG. 13, two series of magnets 308 and 310 are strategically mounted on the sides of the holes 306. As described further on, magnet 308 provides a door zone and level indication at each floor, whereas magnets 310 provide a binary floor code. The right side is used for levelling; the center for relative position; and the left for floor code. The slots are preferably punched into the tape in the center thereof.

The tape is preferably a hardened and tempered steel and supports the strip magnets which are glued thereon. It has been found that by using elongated slots, rather than round holes, the ability to accurately sense the holes, and provide quadrature (see FIG. 14, discussed infra) is greatly enhanced.

As shown in FIGS. 9 and 10, the bottom of tape 300 is bolted to a bracket 312, which is spring-connected to a second bracket 314. The second bracket 314 is then connected to the rail bracket 302. As can be seen in FIG. 10, the tape 300 is provided with slack between the brackets 312 and 314, to permit only a limited amount of elongation of the springs.

FIG. 12 shows one particularly advantageous mounting for the selector system in accordance with the invention. The main selector housing 320 is connected by a bracket 316 to one of the elevator stiles 317. The switch assembly 318 is mounted by bracket 319 on the elevator stile 317. A first cable 321 connects the switch assembly to the main selector housing 320 and a second cable 323 connects the selector to a junction box 333, which in turn is connected to plug-in terminals on the CLC board.

The switch assembly 318 includes an up terminal slowdown switch 327, an emergency terminal speed limiting switch 329, a top directional limit switch 331, a bottom terminal slowdown switch 337, and a bottom directional limit switch 340. FIG. 12 also illustrates the top directional limit cam 342, which is mounted by a bracket 344 to the elevator rail 304 in a manner so as to engage, sequentially, the up slowdown switches 337 and 329 and limit switch 331. A bottom limit cam of similar configuration is mounted at the bottom of the hoistway in such a manner as to engage switches 337 and 340. The top of the elevator car is indicated by 345. As can be seen in FIG. 12, when an elevator is travelling in the upward direction, up terminal slowdown switches 327 and 329 first encounter the cam 342. As described in connection with FIG. 6, the signals from the switches 327 and 329 are supplied to the power controller, and disable the up fast solenoid. Accordingly, the car can then thereafter move in an upward direction only under the power of the up slow solenoid. If the car continues to move in the upward direction, the terminal limit switch 331 engages the cam 342 which disables the up slow solenoid and prevents any further movement of the car in the upward direction.

The construction of the main selector housing 320 can best be described in connection with FIGS. 11, 15 and 16. FIG. 11 illustrates the housing 320 viewed from the opposite side of FIG. 12. FIG. 15 is a top view of the housing, partially in section, without the selector tape 300. As can be seen in FIG. 11, the tape 300 passes through three pairs of opposed guides 322, which are preferably plastic. The preferred construction of such guides is described further on. The main selector housing 320 includes, in addition to the guides, a main sensor board 324 (see FIG. 15) an auxiliary sensor board 325, an auxiliary sensor cover 326 and a microprocessor-containing printed circuit board 328. The sensor board 324 contains magnetic sensing elements for detecting the strip magnets 308 and 310. The auxiliary sensor board 325 contains magnetic sensor elements for detecting the bar magnets 330 when a hole in the tape is in alignment therewith. The processor board 328 is mounted inside of the housing 320. The housing 320 is preferably formed from a piece of sheet metal, in which the sides are bent up to form the sides of the housing 320. This forming of the sheet metal ensures that the portion of the housing 320 that faces the tape will be very flat. Alternatively, moulded plastic with electromagnetic shielding may be employed.

FIG. 16 is a top view of the main sensor board 324 shown in FIG. 15. Preferably the board 324 is formed of a printed circuit board material, which inherently is flat and has excellent tolerances. It is important that the surface on which the individual sensors 332 are mounted is extremely flat and in good alignment with the tape in order to obtain accurate readings. As shown in FIG. 16, the board 324 has a series of holes and slots therein for the purpose of mounting. Moreover, the board has a pair of cylindrical bar magnets 330 mounted thereon along the center line of the board and two series of magnetic sensor devices aligned vertically on either side of the vertical center line. In particular, one side of the board has five magnetic sensor devices, preferably hall effect transducers 332 that are vertically aligned relative to the strip magnets 310 (FIG. 13). The board 324 also includes a pair of multiple hall effect sensors 334 and 335, which are vertically spaced from one another a distance a little greater than the length of magnet 308 of FIG. 13. Finally, a pair of door zone hall effect sensor devices 336 are mounted at approximately a midway point of sensors 334 and 335.

The auxiliary sensor board 325 may be of similar construction to the board 324, i.e., should be relatively flat. A pair of hall effect sensors 338 (one of which is shown schematically in FIG. 15) are attached to board 325 opposite the magnets 330. Accordingly, as the selector housing 320 moves relative to the tape 300, the elongated holes or "slots" 306 move between the magnets 330 and their corresponding sensors 338. Magnets 310 move past the corresponding set of magnetic sensors 332, and magnets 308 move past the corresponding magnetic sensors 334, 335 and 336.

In mounting the magnets and sensors for use in the tape selector system, as noted before it is crucial to mount the various elements with great precision. The selector system in accordance with the invention permits the selector to be manufactured and installed in a manner that such ele ments are properly positioned. In particular, a selector system in accordance with the invention employs a novel mount for the hall effect sensors, novel mounts for the bar magnets 330, a novel template for positioning strip magnets as shown in FIG. 17, and novel guide elements for the tape.

With reference first to the cylindrical magnets, FIGS. 18–20 show a preferred form of mount. The cylindrical bar mount 350 includes a base section 352, a cylindrical holder section 354 which is open along one side and which is attached to the base 354, and a pair of wings 356 extending from opposite sides of the cylindrical sleeve 354.

The base 352 includes a pair of downwardly extending pegs 358, and each of the wings 356 includes a hole 360 for receiving a rivet. The top of the cylindrical sleeve 354 includes inwardly extending arcuate flanges 362 that extend partly into the cylindrical space.

In accordance with the invention, a bar magnet is inserted in the cylindrical sleeve 354. Cylindrical bar magnets tend to have slight variations in size, but because one side of the sleeve is open, the sleeve can expand to accommodate different size magnets. Irrespective of size variations in the magnet, the center of the magnet will vertically always be at the midpoint of the base 352. Accordingly the magnets according to the present invention may be mounted by sliding the bar into the sleeve 354 until the end of the magnet engages the positioning flanges 362. Thereafter the pegs 358 are inserted in holes in the sensor board 324. The holes for receiving pegs 358 are precisely located on the board so that the bases of the two magnet assemblies 330 have the exact desired vertical spacing relative to one another. Preferably, the pegs 358 are square and are inserted in round holes for a slight interference fit. With the pegs 358 inserted in the sensor board 324, the wings 356 are riveted to the board through holes 360. The holes in the board corresponding to holes 360 maybe slightly oversized, to accommodate tolerances, since these holes are not used for positioning the assembly and since, as noted before, variance in magnet dimensions may affect the final position of the holes 360. As shown in FIG. 16, it is preferable to mount the bar magnets with the south face extending outwardly.

FIG. 21 is a sectional view taken through lines 21—21 of FIG. 16, showing a hall effect sensor 370 together with a novel mount 372. As indicated in FIG. 16, both single mounts and multiple mounts are used. Such mounts are similar in construction, as described below.

Typical hall effect sensors presently on the market, i.e., 370, have a relatively rectangular configuration 374 holding the main element, and a projecting portion 376 extending therefrom and containing the leads. Such devices are difficult to mount easily with precision.

Referring first to FIGS. 21 and 22 which show a mount 380 for a single hall effect sensor, the mount includes a flat rectangular base portion, 382, that has a hole formed therein 384 and also is provided with a downwardly extending peg 386. The peg 386 is preferably rectangular and is received in a round hole in the sensor board 324. An eave portion 388 extends forwardly from the base portion 382 and is spaced slightly higher than the bottom surface of the base. The eave portion contains a border 390 with a pocket 392 configured to the outer rectangular surface of the hall effect device. The pocket 390 includes a square cutout 394 to expose the hall effect sensor.

In mounting the hall effect sensors 370 on the board, the sensor is positioned in its approximate desired location, and the mount 380 is positioned over the hall effect sensor element 374. The element 374 is received in the square receptacle 392 and securely held in place in the receptacle pocket 390. Thereafter, the mount 380 is pressed into the board, and staked. As shown in FIG. 24, a mount for a multiple hall effect device is similar in configuration to the mount shown in FIGS. 22 and 23 but provides multiple pockets for the hall effect devices. In the case of a multiple mount, it is desirable to employ a pair of mounting pegs 386 and holes 384.

FIG. 17 shows a template for mounting magnets on the selector tape. The template includes an edge which acts as a reference point, and cutouts sized and located for positioning magnets. The cutouts on the left side of the template may be used to position magnets in a binary code indicative of floor level. In this regard, the decision of whether or not to position a magnet in a particular slot would depend on the binary address assigned for that floor. Preferably, the template includes written indicia associated with the position slots indicating the floors at which a magnet is positioned. For example, as illustrated in FIG. 17. the sixth floor is provided with a magnet in the first, third, and fifth locations, whereas the third floor is provided with a magnet only in the fourth slot location.

FIGS. 25–28 show the construction of a tape guide. Each tape guide 322 is formed by a pair of guide elements 400, each of which is the same. One of the guide elements is shown in FIGS. 26–28. The guide face 402 of the guide elements includes a first elevated guide surface 404 extending longitudinally along one edge of the guide element 400 and a depressed, second guide surface, 406 extending longitudinally along the opposite edge. Holes 408 are provided for attaching the guide pairs to the selector housing 320, although all the holes need not be used. Also, interfit holes 410 and projections 412 are provided on the inner face 402, equidistant from the longitudinal center line. The outer surface 418 of the guide 400 may be provided with one or more guide pegs 414, 416 that are received in corresponding holes and slots in the main and auxiliary sensor boards. As shown in FIG. 28, the pegs 414, 416 may be of different shapes or sizes so as to prevent the installation of the guide assembly upside down.

When assembled, the projections 412 of one guide member 400 fit into the corresponding holes 410 of the other member 400, and ensure that the parts mate in the proper configuration as shown in FIG. 25.

In operation, the magnets may be placed in the hoistway during setup by moving the car to a floor level position, marking a indicia on the tape representative of the proper position for the template, and thereafter aligning the template with the selector tape and applying the magnets. Preferably, the template is the same width as the tape. Once the tapes are positioned, and proper elevator stopping position is verified, the magnets may be glued to the tape for each floor.

In operation, the hall effect devices 338 on the auxiliary board 325 detect the magnets 330 when the elongated holes or slots are present and do not detect the magnets between the elongated holes. The slots are preferably sized to produce a square wave output from each of the sensors, and preferably the sensors are spaced from one another so as to be 90 degrees out of phase, as shown in FIG. 14. These signals are sent to the selector, which counts the pulses to determine elevator travel distance. Moreover, as can be seen in FIG. 14 the microprocessor determines the direction of elevator travel from the sequence of the signals received. As shown in FIG. 14, during portions of the elevator travel the signal from both magnet sensors is zero, for example at position A. Thereafter, each signal will become positive, but in opposite sequence depending upon the direction of elevator travel. By determining the state of phase B on a transition of phase A, the microprocessor can determine the direction of elevator travel. The selector reads the binary floor position sensors whenever the car becomes level with a landing, i.e. when the door zone sensor is actuated and the LU and LD sensors are not.

Floor levelling can be illustrated by FIG. 16 which includes level up sensors 334 and level down sensors 335. If the car is exactly level with the floor, magnet 308 (FIG. 13) will be centrally positioned relative to sensors 334 and 335. Magnet 308 will however energize DZ sensor 336, which represents the door zone signal. This signal indicates that the elevator is at the landing and permits the doors to be opened. At such time as the elevator is not level with the floor, the magnet 308 will activate sensor 334 or 335, indicating that the car is too high or too low.

FIG. 16 shows four sensors for the level up and level down sensor units 334, 335. It is possible to provide an assembly having only a single sensor at such a point to provide the level up and level down signals. In the embodiment shown in FIG. 16, however, it is possible to select which sensors are to be used for signals. By changing the sensor connections, the size of the dead zone can be appropriately varied.

We claim:

1. In an elevator system including a car vertically displaceable between landings, a selector comprising:

a metal tape vertically supported relative to said landings, said tape including longitudinal edges and a plurality of holes spaced from said edges and vertically aligned, a first set of strip magnets for identifying each landing, and a second set of strip magnets for indicating door zone position at each landing, said first and second sets of magnets lying on opposite sides of said holes inwardly from the respective edges; and a selector unit including a selector housing mounted on the elevator car, guide means on said housing for engaging the edges of said tape for guiding said tape for maintaining precise horizontal positioning relative to the selector unit, a first bar magnet, and a first magnetic sensor means, means for mounting said bar magnet and first sensor means on opposite sides of said tape, in opposed relation to one another and in registry with said holes, second magnetic sensor means mounted on said housing in vertical alignment with said first set of strip magnets, and third magnetic sensor means mounted on said housing in vertical alignment with said second set of strip magnets, wherein said first sensor means produces a signal when aligned with any of the holes, and wherein said holes are elongated in the lateral direction for producing a sharp, strong magnetic signal in said first sensor means compared to holes of round configuration.

2. An elevator system as defined in claim 1, wherein said guide means includes guide elements on said housing, at least one disposed to either side of the tape, wherein each of the guide elements includes a pair of complementary guide components, means for attaching the components together in registry, and wherein the components have edge ortions spaced from one another to define a guide slot receiving an edge of the tape in frictional engagement.

3. An elevator system as defined in claim 2, wherein the guide components are identical and define guide slots along opposite edges thereof, and may be reversably mounted to the selector housing.

4. An elevator system as defined in claim 1, wherien the magnetic sensor means comprise hall effect sensors, wherien the first set of strip magnets are arranged in a coded binary array at each floor, wherein said second sensor means includes a plurality of hall effect sensors positioned at each binary position of the magnets for reading floor codes, wherein the third sensor means includes a first set of vertically spaced hall effect sensors, a second set of vertically spaced hall effect sensors, said first and secon sensor sets being spaced apart slightly further than the length of the door zone magnets, wherein electrical outputs of different hall effect sensors in each set may be chosen to vary the door zone travel of the elevator car, and wherein a door zone hall effect sensor is vertically disposed between said first and second set.

5. An elevator system as defined in claim 1, wherein said bar magnet is cylindrical and the means for mounting said bar magnet comprises a holder having a base portion with a bottom surface and a pair of projections extending perpendicularly therefrom; a cylindrical sleeve, engaging said magnet, which is supported from one edge of the base portion and extends perpendicular to said bottom surface, wherin the sleeve is open along one side and is thereby enlargeable; and a pair of ears extending laterally from opposite sides of the cylindrical sleeve, and comprising attachment means for mounting said base portion and said ears to said selector housing.

6. An elevator system as defined in claim 5, wherein the attachment means includes a hole formed in each ear and at least one projection on said base portion.

7. An elevator system as defined in claim 6, wherein said cylindrical sleeve includes an arcuate flange formed therein at the end of the sleeve adjacent the base portion, for positioning the end of a cylindrical magnet.

8. An elevator system as defined in claim 1, wherein at least one of said sensor means is a hall effect sensor of the type having a sensor body and a lead section extending therefrom, and comprising a positioning member for mounting said hall effect sensor to said selector housing comprising a base section having an edge, a bottom surface, and means for attaching said base section to said selector housing; and eave poriton extending from said edge of the base portion and being elevated relative to the bottom surface of the base, wherein the eave includes an outer border defining a depressed pocket shaped for receiving the sensor body of said hall effect sensor, the pocket extending upwardly therein, and further the eave having a cutout interior of the border for exposing the hall effect sensor.

9. An elevator system as defined in claim 8, wherein the the base section attachment means includes a projection extending downwardly from said bottom surface and a hole through said base section for receiving a rivet.

10. An elevator system as defined in claim 1, wherein said third sensor means comprises two sets of hall effect sensors at vertically spaced positions, each set including more than one hall effect sensor, a positioning member for mounting each set of hall effect sensors comprising a base section having an edge and a bottom surface; an eave portion extending from said edge of the base portion and being elevated relative to the bottom surface of the base, wherein the eave portion includes outer borders defining a plurality of upwardly extending pockets each for receiving one of the hall effect sensors, and further the eave portion having cutouts interior of the borders for exposing the hall effect sensors, and where in further the base section includes means for mounting to a sensor board.

11. In an elevator system including a car vertically displaceable between landings, a selector comprising:

a tape vertically supported relative to said landings, said tape including longitudinal edges and plurality of holes spaced from said edges and vertically aligned; and a selector unit including a selector housing mounted on the elevator car, guide means on said housing for engaging the edges of said tape for guiding said tape, and sensor means vertically aligned with said holes for detecting the holes, wherein said guide means includes a plurality of guide elements on said housing, disposed to either side of the tape, and wherein each of the guide elements includes a pair of complementary guide components, means for attaching the components together in registry, and wherein the components have edge portions spaced from one another to define a guide slot receiving an edge of the tape in frictional engagement.

12. An elevator system as defined in claim 11, wherein said guide components have abutting surfaces and wherein the means for attaching the components together comprises first and second pairs of mating projections and holes, the projection and hole for each pair being formed on and in, respectively, the abutting surfaces.

13. In an elavator system including a car vertically displaceable between landings, a selector comprising:

a tape vertically supported relative to said landings, said tape including longitudinal edges and a plurality of holes spaced from said edges and vertically aligned; and a selector unit including a selector housing mounted on the elevator car, guide means on said housing for engaging the edges of said tape for guiding said tape, a first bar magnet and a first sensor means, means for mounting said bar magnet and first magnetic sensor means on opposite sides of said tape, in opposed relation to one another and in registry with said holes;

wherein said bar magnet is cylindrical and the means for mounting said bar magnet is a choler comprising a base portion with a bottom surface and a pair of projections extending perpendicularly therefrom; a cylindrical sleeve, engaging said magnet, which is cupported from one edge of the base portion and extends perpendicular to said bottom surface, wherein the sleeve is open along one side and is thereby enlargeable; and a pair of ears extending laterally from opposite sides of the cylindrical sleeve, and comprising attachment means for mounting said base portion and said ears to said selector housing.

14. An elevator system as defined in claim 13, wherein the attachment means includes a hole formed in each ear and at least one projection on said base portion.

15. An elevator system as defined in claim 14, wherein said cylindical sleeve includes an arcuate flange formed therein at the end of the sleeve adjacent to base poriton for positioning the end of a cylindrical magnet.

16. In an elevator system including a car vertically displaceable between landings, a selector comprising:

a tape vertically supported relative to said landings, said tape including longitudinal edges and a plurality of holes spaced from said edges and vertically aligned, a first set of strip magnets for identifying each landing, and a second set of strip magnets for indicating door zone position at each landing, said first and second sets of magnets lying on opposite sides of said holes inwardly from the respective edges; and a selector unit including a selector housing mounted on the elevator car, guide means on said housing for engaging the edges of said tape for guiding said tape, a first bar magnet and a first magnetic sensor means, on opposite sides of said tape, in opposed relation to one another and in registry with said holes, second magnetic sensor means mounted on said housing in vertical alignment with said first set of strip magnets, and third magnetic sensor means mounted on said housing in vertical alignment with said second set of strip magnets;

wherein at least one of said sensor means is a hall effect sensor of the type having a sensor body and a lead section extending therefrom, and comprising a positioning member for mounting said hall effect sensor to said selector housing comprising a base section having an edge and a bottom surface, means for attaching said base section to said selector housing, an eave portion extending from said edge of the base portion and being elevated relative to the bottom surface of the base, where in the eave includes an outer border defining a depressed pocket shaped for receiving the sensor body of said hall effect sensor, the pocket extending upwardly therein, and further the eave having a cutout interior of the border for exposing the hall effect sensor.

17. An elevator system as defined in claim 16, wherein said third sensor means comprises two sets of hall effect sensors at vertically spaced positions, each set including more than one hall effect sensor, a positioning member for mounting each set of hall effect sensors comprising a base section having an edge and a bottom surface, means for attaching said base section to said selector housing; and eave portion extending from said edge of the base poriton and being elevated relative to the bottom surface of the base, wherein the eave portion includes outer borders defining a plurality of upwardly extending pockets each shaped for receiving the sensor body of one of the hall effect sensors, and further the eave portion having cutouts interior of the borders for exposing the hall effect sensors, and wherein further the base includes means for mounting to a sensor board.

18. An elevator system as defined in claim 17, wherein said housing includes a sensor board made of a piece of printed circuit board material, and wherein said positioning members are mounted to said sensor board.

19. In an elevator system including a car vertically displaceable between landings, a selector comprising:

a metal tape vertically supported relative to said landings, said tape including longitudinal edges and a plurality of holes spaced from said edges and vertically aligned, a first set of strip magnets for indentifying each floor landing, and a second set of strip magnets for indicating door zone position at each landing, said first and second sets of magnets lying on opposite sides of said holes inwardly from the respective edges; and a selector unit including a selector housing mounted on the elevator car and comprising:

a plurality of guide elements, each guide element including a pair of guide components, wherein said guide components have abutting surfaces and mating projections and holes formed thereon and therein, respectively, for attaching the components together and wherein the components have edge portions spaced from one another to define a guide slot;

means for mounting said guide elements on said housing such that at least one guide element lies to either side of the tape and the slots of the opposed guide elements receive opposite edges of the tape in frictional engagement;

a sensor board and an auxiliary sensor board positioned on opposite sides of said tape so as to be parallel to said tape, wherein said boards are made from printed circuit board material;

a pair of cylindrical bar magnets;

means for mounting said bar magnets on said sensor board to be vertically spaced from one another;

a pair of first hall effect sensors;

means for mounting said hall effect sensors on said auxiliary sensor board to be vertically spaced from one another and such that said bar magnets and sensors lie opposite one another in registry with said holes;

a plurality of second hall effect sensors;

means for mounting said second hall effect sensors on said sensor board in vertical alignment with the floor landing magnets;

a plurality of pairs of third hall effect sensor, each pair including an upper hall effect sensor and a lower hall effect sensor;

means for mounting said upper hall effect sensors and for mounting the lower hall effect sensors on said sensor board in vertical alignment with one another and with the door zone magnets, wherein the upper and lower hall effect sensors of respective pairs are spaced apart by difference distances, but at least the length of the door zone magnet, so that electrical outputs of different hall effect sensor pairs may be chosen to bary the door zone travel of the elevator car;

wherein the means for mounting the bar magnets to the sensor board comprises a pair of holders, each having a base portion with a bottom surface and a pair of projections extending downwardly therefrom; a cylindrical sleeve, engaging said magnet, which is supported from on edge of the base portion and extends perpendicular to said bottom surface, wherein the sleeve is open along one side and is thereby enlargeable and includes an arcuate flange formed therein at the end of the sleeve, adjacent to the base portion, for positioning the end of a cylindrical magnet; a pair of ears extending laterally from opposite sides of the cylindrical sleeve; and wherein each ear has a hole therethrough;

wherein the means for attaching each of the first and second hall effect sensors comprises a positioning member including a base section having an edge and a bottom surface; an eave portion extending from said edge of the base portion and being elevated relative to the bottom surface of the base, wherein the eave portion includes an outer border defining a depressed pocket for receiving a hall effect sensor, the pocket extending upwardly therein, and further the eave having a cutout interior of the border for exposing the hall effect sensor, and wherein the base section includes a downwardly extending projection and hole for attachment to the sensor board or auxiliary sensor board, respectively; and wherein the means for mounting the upper hall effect sensors and the lower hall effect sensors comprises a pair of multiple hall effect sensor positioning members, each comprising a base section having an edge and a bottom surface; an eave portion extending from said edge of the base portion and being elevated relative to the bottom surface of the base, wherein the eave portion includes outer borders defining a plurality of upwardly extending pockets each for receiving one of the hall effect sensors, and further the eave portion having cutouts interior of the borders for exposing the hall effect sensors, and wherein further the base section includes a downwardly extending projection and a hole for mounting to the sensor board.

* * * * *

UNITED STATES PATENT AND TRADEMARK OFFICE

CERTIFICATE OF CORRECTION

PATENT NO. : 4,798,267

DATED : January 17, 1989

INVENTOR(S) : Richard M. Foster and Kermit L. Racely

It is certified that error appears in the above-identified patent and that said Letters Patent is hereby corrected as shown below:

Col. 1, line 37, "feexibility" should read --flexibility--;

Col. 1, line 45, "reltively" should read --relatively--;

Col. 5, line 56, "he" should read --the--;

Col. 7, line 53, "controlless" should read --controllers--;

Col. 10, line 52, "signa" should read --signal--;

Col. 16, line 2, "337" should read --327--;

Col. 20, line 16, "ortions" should read --portions--;

Col. 20, line 32, "secon" should read --second--;

Col. 20, line 66, "and eave poriton" should read --an eave portion--;

Col. 21, bridging lines 23-24, "where in" should read --wherein--;

UNITED STATES PATENT AND TRADEMARK OFFICE

CERTIFICATE OF CORRECTION

PATENT NO. : 4,798,267

DATED : January 17, 1989

INVENTOR(S) : Richard M. Foster and Kermit L. Racely

It is certified that error appears in the above-identified patent and that said Letters Patent is hereby corrected as shown below:

Col. 21, last line, "choler" should read --holder--;

Col. 22, line 65, "and" should read --an--;

Col. 22, line 66, "poriton" should read --portion--;

Col. 23, line 29, after "together" insert a comma

Col. 24, line 12, "comprises" should read --comprise--.

Signed and Sealed this

First Day of August, 1989

*Attest:*

*Attesting Officer*

DONALD J. QUIGG

*Commissioner of Patents and Trademarks*